US007401896B2

(12) United States Patent
Konno

(10) Patent No.: US 7,401,896 B2
(45) Date of Patent: Jul. 22, 2008

(54) LIQUID DROPLET EJECTION HEAD, LIQUID DROPLET EJECTION APPARATUS AND IMAGE RECORDING METHOD

(75) Inventor: Masaaki Konno, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 296 days.

(21) Appl. No.: 11/391,568

(22) Filed: Mar. 29, 2006

(65) Prior Publication Data

US 2006/0221125 A1 Oct. 5, 2006

(30) Foreign Application Priority Data

Mar. 30, 2005 (JP) ..... 2005-099064
Mar. 30, 2005 (JP) ..... 2005-099065

(51) Int. Cl.
*B41J 2/205* (2006.01)

(52) U.S. Cl. ..... 347/43; 347/68

(58) Field of Classification Search ..... 347/12, 347/15, 19, 40, 43, 68–71
See application file for complete search history.

(56) References Cited

U.S. PATENT DOCUMENTS 6,325,489 B2 * 12/2001 Endo ..... 347/43
6,789,877 B2 * 9/2004 Murakami et al. ..... 347/40
6,921,149 B2 7/2005 Okuda et al.
2002/0105557 A1 * 8/2002 Teshigawara et al. ..... 347/15
2004/0150693 A1 8/2004 Kojima et al.

FOREIGN PATENT DOCUMENTS

JP 2004-90504 A 3/2004
JP 2004-167982 A 6/2004

* cited by examiner

*Primary Examiner*—Lamson D. Nguyen
(74) *Attorney, Agent, or Firm*—Birch, Stewart, Kolasch & Birch, LLP

(57) ABSTRACT

The liquid droplet ejection head has a plurality of nozzles arranged in a fixed arrangement pattern two-dimensionally in a first direction and a direction oblique to the first direction. The nozzles compose a projected nozzle row in the first direction when supposing that the nozzles are projected so as to align in the first direction; first one of the nozzles and second one of the nozzles are located in a juncture region; a distance in a second direction perpendicular to the first direction between the first and second nozzles is larger than a distance in the second direction between other two of the nozzles that are located in a region other than the juncture region and sequenced in the projected nozzle row; third at least one of the nozzles lies substantially halfway between the first and second nozzles; and the first, third and second nozzles are sequenced in the projected nozzle row.

25 Claims, 26 Drawing Sheets

FIG.16A

| OUTPUT DENSITY d | ADJUSTED LIQUID DROPLET EJECTION VOLUME A OF CENTRAL NOZZLES |
|---|---|
| d1 | A1 |
| d2 | A2 |
| d3 | A3 |

FIG.16B

| OUTPUT DENSITY d | ADJUSTED LIQUID DROPLET EJECTION VOLUME A OF CENTRAL NOZZLES |
|---|---|
| dd1<d<dd2 | A1 |
| dd2≦d<dd3 | A2 |
| dd3≦d<dd4 | A3 |

FIG.17

| HEAD ANGLE | α |
|---|---|

| $\alpha' - \alpha$ (deg) | VOLTAGE VALUE CORRECTION COEFFICIENT |
|---|---|
| $4 \times 10^{-2}$ | -1.045 |
| $3 \times 10^{-2}$ | -1.033 |
| $2 \times 10^{-2}$ | -1.022 |
| $1 \times 10^{-2}$ | -1.011 |
| 0 | 1 |
| $-1 \times 10^{-2}$ | 1.011 |
| $-2 \times 10^{-2}$ | 1.022 |
| $-3 \times 10^{-2}$ | 1.033 |
| $-4 \times 10^{-2}$ | 1.045 |

FIG.26A

| OUTPUT DENSITY d | ADJUSTED LIQUID DROPLET EJECTION VOLUME A OF JUNCTURE REGION NOZZLES |
|---|---|
| d1 | A1 |
| d2 | A2 |
| d3 | A3 |

FIG.26B

| OUTPUT DENSITY d | ADJUSTED LIQUID DROPLET EJECTION VOLUME A OF JUNCTURE REGION NOZZLES |
|---|---|
| $dd1 < d < dd2$ | A1 |
| $dd2 \leqq d < dd3$ | A2 |
| $dd3 \leqq d < dd4$ | A3 |

FIG.27

| $\alpha' - \alpha$ (deg) | VOLTAGE VALUE CORRECTION COEFFICIENT |
|---|---|
| −0.005 | 1.117 |
| −0.004 | 1.092 |
| −0.003 | 1.067 |
| −0.002 | 1.044 |
| −0.001 | 1.021 |
| 0 | 1 |
| 0.001 | 0.979 |
| 0.002 | 0.960 |
| 0.003 | 0.941 |
| 0.004 | 0.922 |
| 0.005 | 0.905 |

FIG.28

| $\alpha' - \alpha$ (deg) | VOLTAGE VALUE CORRECTION COEFFICIENT | |
|---|---|---|
| | JUNCTURE REGION NOZZLES | JUNCTURE REGION ADJACENT NOZZLES |
| −0.005 | 1.117 | 0.952 |
| −0.004 | 1.092 | 0.961 |
| −0.003 | 1.067 | 0.970 |
| −0.002 | 1.044 | 0.980 |
| −0.001 | 1.021 | 0.990 |
| 0 | 1 | 1 |
| 0.001 | 0.979 | 1.011 |
| 0.002 | 0.960 | 1.022 |
| 0.003 | 0.941 | 1.034 |
| 0.004 | 0.922 | 1.045 |
| 0.005 | 0.905 | 1.059 |

LIQUID DROPLET EJECTION HEAD, LIQUID DROPLET EJECTION APPARATUS AND IMAGE RECORDING METHOD

BACKGROUND OF THE INVENTION

1. Field of the Invention

The present invention relates to a liquid droplet ejection head, a liquid droplet ejection apparatus, and an image recording method, and more particularly, to a liquid droplet ejection head, a liquid droplet ejection apparatus and an image recording method in which a plurality of nozzles are arranged in a matrix configuration.

2. Description of the Related Art

In recent years, inkjet recording apparatuses have come to be used widely as data output apparatuses for outputting images, documents, or the like. In an inkjet recording apparatus, a desired image is formed on a recording medium by ejecting ink droplets from a plurality of nozzles in a print head (liquid droplet ejection head).

The print head used in an inkjet recording apparatus may be a full line head having one or more than one nozzle row of a length corresponding to the full width of the recording medium, or a serial head which forms dot rows in a main scanning direction by scanning a short head, which has a shorter length than the full width of the recording medium, in the breadthways direction of the recording medium (main scanning direction). A full line head is able to print onto the full area of the printable region of the recording medium by scanning the recording medium once, by moving the head and the recording medium relatively to each other in a direction substantially perpendicular to the breadthways direction of the recording medium (sub-scanning direction). Therefore, it is able to print at higher speed than a serial head.

A print head (matrix type head) is commonly known in which a plurality of nozzle are arranged in a matrix configuration (two-dimensionally) in order to achieve high quality in the image formed by the inkjet recording apparatus. For example, as shown in FIG. 30, there is a head in which a plurality of nozzles 51 are arranged in a matrix configuration, on the basis of a fixed arrangement pattern aligned in a row direction following the main scanning direction, which is perpendicular to the relative conveyance direction of the recording medium (the paper conveyance direction), and an oblique column direction which is not perpendicular to the main scanning direction. By constituting a print head of this kind as a full line head, it is possible to treat the nozzle rows when projected so as to align in the main scanning direction as a linear arrangement of nozzles, and it is possible to form a dot row of a single line in the main scanning direction of the recording medium, by driving the nozzles in a prescribed sequence, while moving the print head and the recording medium relatively with respect to each other. However, in the case of full line heads, there is a problem in that density non-uniformity tends to become more conspicuous in a prescribed direction, such as the main scanning direction on the recording medium, due to variation in the ejection characteristics, such as the volume and speed of flight of the ink droplets ejected from the nozzles. In particular, in the case of a matrix type head in which the nozzles are arranged in a matrix configuration, the spatial separation between the nozzles which are mutually adjacent in the main scanning direction is an additional factor which makes density non-uniformity become more conspicuous.

Therefore, technology has been proposed for reducing the visibility of the density non-uniformity which is liable to occur in a print head in which a plurality of nozzles are arranged in a matrix configuration in this fashion (namely, a matrix type head) (see Japanese Patent Application Publication Nos. 2004-90504 and 2004-167982).

Japanese Patent Application Publication No. 2004-90504 discloses a nozzle arrangement in which, in a dot row formed in the sub-scanning direction while moving a print head relatively in the main scanning direction, a dot of a different dot diameter is positioned between two mutually adjacent dots of the same dot diameter.

Japanese Patent Application Publication No. 2004-167982 discloses a nozzle arrangement in which the size of the dot diameter is varied in a dot row formed in the sub-scanning direction while moving the print head relatively in the main scanning direction.

In both Japanese Patent Application Publication Nos. 2004-90504 and 2004-167982, rather than increasing or decreasing the dot diameter in the dot row formed in the sub-scanning direction in a linear fashion, large and small dots are combined in the sub-scanning direction and hence the visibility of the density non-uniformity in the sub-scanning direction is reduced.

Problems of the following kinds occur in a matrix type head in the related art shown in FIG. 30.

In FIG. 30, P0 is taken to be the pitch of the nozzles in the main scanning direction, P1 is taken to be the pitch of the nozzles that are mutually adjacent in the main scanning direction (in other words, the pitch of the nozzles that eject droplets at the same timing), P2 is taken to be the pitch of the nozzles in the main scanning direction in the juncture region (the junction section between nozzle rows), P3 is taken to be the pitch of the nozzles in the sub-scanning direction (the paper feed direction), and P4 is taken to be the pitch of the nozzles in the sub-scanning direction in the juncture region (the junction section between nozzle rows).

The juncture region (nozzle row junction section) is the boundary (junction section) between one nozzle row extending in an oblique column direction and another nozzle row which is adjacent to same in the main scanning direction. Furthermore, a nozzle at the end of a nozzle row in the oblique column direction, in a juncture region, is called a "juncture region nozzle". For example, there is a juncture region between the nozzle row 51A-1 constituted by the seven nozzles 51-11 to 51-17 which are aligned in the oblique column direction, and the nozzle row 51A-2 which is adjacent to the nozzle row 51A-1 in the main scanning direction, where the juncture region nozzles are nozzle 51-17 and nozzle 51-21. In the juncture regions, the nozzle pitch in the sub-scanning direction (in other words, the nozzle pitch in the sub-scanning direction between the juncture region nozzles) P4, is greater than the nozzle pitch P3 in the sub-scanning direction in the other regions.

In a matrix type head in the related art, if the head is accurately installed in such a manner that it forms a prescribed angle with respect to the conveyance direction of the recording paper (the paper freed direction), (for example, if the lengthwise direction of the head is perpendicular to the paper feed direction), then the nozzle pitch P2 in the main scanning direction in the juncture regions is equal to the nozzle pitch P0 in the main scanning direction in the other regions (in other words, P2=P0), and the nozzle row projected to the main scanning direction (projected nozzle row) has a uniform nozzle pitch of P0 (=P2). Therefore, as shown in the lower part of FIG. 30, a dot row is formed in which dots are arranged at regular intervals in the main scanning direction of the recording medium, at a dot pitch P that is equal to the nozzle pitch P0 (=P2).

However, if the print head is removed and reinstalled in a head maintenance operation, or the like, then a slight deviation may arise in the angle of the print head with respect to the paper feed direction. In cases of this kind, the nozzle pitch P2 in the main scanning direction in the juncture regions becomes different to the nozzle pitch P0 in the main scanning direction in the other regions (in other words, P2≠P0), and hence portions of high density and portions of low density appear in the dot row formed in the main scanning direction, and this may give rise to visible density non-uniformity in the main scanning direction.

For example, if the print head is installed in a state where it has been rotated in the direction of the arrow A1 in FIG. 30, then the nozzle pitch P0 in regions other than the juncture regions becomes slightly smaller, whereas the nozzle pitch P2 in the main scanning direction in the juncture regions becomes larger. Therefore the nozzle pitch P2 becomes greater than the nozzle pitch P0 in the main scanning direction in the other regions. Consequently, even in an ideal state where there is absolutely no error in the ejection volume or ejection direction of any of the nozzles, the dot row formed in the main scanning direction of the recording medium has a larger dot pitch in the portions corresponding to the juncture regions, and hence the density becomes lower in these portions. On the other hand, if the print head is installed in a state where it has been rotated in the direction of arrow A2 in FIG. 30, then conversely to the situation described in the previous example, the nozzle pitch P2 in the main scanning direction in the juncture regions becomes smaller than the nozzle pitch P0 in the main scanning direction in the other regions. Therefore, even if all of the nozzles are in an ideal state, a dot row formed in the main scanning direction on the recording paper has a smaller dot pitch in the portions corresponding to the juncture regions, and hence the density becomes higher in these portions. In this way, in the case of a matrix head, portions of different density are visible at the intervals of the nozzle pitch P1 between nozzles that are mutually adjacent in the main scanning direction.

In a matrix type head in the related art of this kind, since the nozzle pitch P4 in the sub-scanning direction in the juncture regions is greater than the nozzle pitch P3 in the sub-scanning direction in the other regions, and since the nozzle pitch P2 in the main scanning direction in the juncture regions changes conversely to the nozzle pitch P0 in the main scanning direction in the other regions when the head is rotated, then any slight deviation in the angle of the head with respect to the conveyance direction of the recording medium (the head angle) causes the nozzle pitch P2 in the main scanning direction in the juncture regions to greatly differ from the nozzle pitch P0 in the main scanning direction in the other regions. This gives rise to highly conspicuous density non-uniformity in the main scanning direction on the recording medium.

Japanese Patent Application Publication Nos. 2004-90504 and 2004-167982 do not take any account of density non-uniformity occurring in the juncture regions, and hence they cannot effectively reduce the visibility of density non-uniformity occurring in the juncture regions of a matrix type head of this kind.

SUMMARY OF THE INVENTION

The present invention has been contrived in view of the foregoing circumstances, an object thereof being to provide a liquid droplet ejection head, a liquid droplet ejection apparatus and an image recording method whereby the visibility of density non-uniformity occurring in the juncture regions of a liquid droplet ejection head having a plurality of nozzle arranged in a matrix configuration, can be reduced.

In order to attain the aforementioned object, the present invention is directed to a liquid droplet ejection head having a plurality of nozzles arranged in a fixed arrangement pattern two-dimensionally in a first direction and a direction oblique to the first direction, wherein: the nozzles compose a projected nozzle row in the first direction when supposing that the nozzles are projected so as to align in the first direction; first one of the nozzles and second one of the nozzles are located in a juncture region; a distance in a second direction perpendicular to the first direction between the first and second nozzles is larger than a distance in the second direction between other two of the nozzles that are located in a region other than the juncture region and sequenced in the projected nozzle row; third at least one of the nozzles lies substantially halfway between the first and second nozzles; and the first, third and second nozzles are sequenced in the projected nozzle row.

According to the present invention, by arranging third at least one nozzle in the substantially central position between the first nozzle and the second nozzle in the juncture region in the liquid droplet ejection head having the plurality of nozzle arranged two-dimensionally (in a matrix configuration), then the nozzle pitch in the second direction in the juncture region becomes smaller, and the visibility of density non-uniformity occurring in the juncture regions can be reduced.

If the matrix type head is constituted by a full line type head, then the first direction is the main scanning direction, which is a direction substantially perpendicular to the relative conveyance direction of the recording medium with respect to the head, and the second direction is the sub-scanning direction, which is the relative conveyance direction of the recording medium with respect to the head.

Furthermore, if the matrix type head is a serial type head, then the second direction is the main scanning direction which is the scanning direction of the head (the breadthways direction of the recording medium), and the first direction is the sub-scanning direction, which is the relative conveyance direction of the recording medium with respect to the head.

Preferably, a first nozzle row of the nozzles in the oblique direction and a second nozzle row of the nozzles in the oblique direction are mutually adjacent in the first direction; the first nozzle is at an end of the first nozzle row on a side adjacent to the second nozzle row; and the second nozzle is at an end of the second nozzle row on a side adjacent to the first nozzle row.

According to this aspect of the present invention, by disposing third at least one nozzle at the substantially central position between the first nozzle at the end of the first nozzle row on the side adjacent to the second nozzle row, and the second nozzle at the end of the second nozzle row on the side adjacent to the first nozzle row, it is possible to reduce the visibility of density non-uniformity occurring in the juncture region, which is the junction section between the first nozzle row and the second nozzle row.

Preferably, the first direction is a main scanning direction which is substantially perpendicular to a relative conveyance direction of a recording medium with respect to the liquid droplet ejection head; and the second direction is a sub-scanning direction which coincides with the relative conveyance direction of the recording medium with respect to the liquid droplet ejection head.

According to this aspect of the present invention, it is possible to reduce the visibility of density non-uniformity occurring in the main scanning direction in the juncture regions.

Preferably, the nozzles are arranged in the projected nozzle row at regular intervals.

According to this aspect of the present invention, dots can be formed in the first direction at the regular intervals, thus facilitating image processing.

In order to attain the aforementioned object, the present invention is also directed to a liquid droplet ejection apparatus, comprising: the above-described liquid droplet ejection head; and a liquid droplet volume adjustment device which adjusts a liquid droplet ejection volume of the third nozzle.

According to the present invention, by correcting the liquid droplet ejection volume of the third nozzle, it is possible further to reduce the visibility of density non-uniformity occurring in the juncture regions.

Preferably, the liquid droplet ejection apparatus further comprises: a head angle determination device which determines a head angle of the liquid droplet ejection head with respect to a prescribed direction, wherein the liquid droplet volume adjustment device adjusts the liquid droplet ejection volume of the third nozzle according to the head angle determined by the head angle determination device.

According to this aspect of the present invention, by correcting the liquid droplet ejection volume of the third nozzle on the basis of the head angle, it is possible reliably to reduce the visibility of density non-uniformity occurring in the juncture regions.

Preferably, the prescribed direction is the second direction (the relative conveyance direction of the recording medium).

Preferably, the liquid droplet ejection apparatus further comprises: a test pattern creating device which creates a test pattern by the liquid droplet ejection head; and a density distribution measurement device which measures a density distribution on the test pattern, wherein the liquid droplet volume adjustment device adjusts the liquid droplet ejection volume of the third nozzle according to the density distribution on the test pattern measured by the density distribution measurement device.

According to this aspect of the present invention, by correcting the liquid droplet ejection volume of the third nozzle on the basis of the density distribution on the test pattern, it is possible reliably to reduce the visibility of density non-uniformity occurring in the juncture regions.

Preferably, the liquid droplet volume adjustment device adjusts the liquid droplet ejection volume of the third nozzle according to an output density of an image.

According to this aspect of the present invention, it is possible to achieve highly precise correction in accordance with the output density of the image, and it is therefore possible further to reduce the visibility of density non-uniformity occurring in the juncture regions.

In order to attain the aforementioned object, the present invention is also directed to an image recording method using the above-described liquid droplet ejection apparatus, wherein an image is recorded while adjusting the liquid droplet ejection volume of the third nozzle.

In order to attain the aforementioned object, the present invention is also directed to an image recording method using the above-described liquid droplet ejection apparatus, wherein an image is recorded while adjusting the liquid droplet ejection volume of the third nozzle according to the head angle determined by the head angle determination device.

In order to attain the aforementioned object, the present invention is also directed to an image recording method using the above-described liquid droplet ejection apparatus, wherein an image is recorded while adjusting the liquid droplet ejection volume of the third nozzle according to the density distribution on the test pattern measured by the density distribution measurement device.

In order to attain the aforementioned object, the present invention is also directed to a liquid droplet ejection apparatus, comprising: a liquid droplet ejection head which has a plurality of nozzles arranged in a fixed arrangement pattern two-dimensionally in a first direction and a direction oblique to the first direction, the nozzles composing a projected nozzle row in the first direction when supposing that the nozzles are projected so as to align in the first direction, first one of the nozzles and second one of the nozzles being located in a juncture region and sequenced in the projected nozzle row, a distance in a second direction perpendicular to the first direction between the first and second nozzles being larger than a distance in the second direction between other two of the nozzles that are located in a region other than the juncture region and sequenced in the projected nozzle row; and a liquid droplet volume adjustment device which adjusts a liquid droplet ejection volume of a juncture region nozzle corresponding at least one of the first and second nozzles.

According to the present invention, by correcting the liquid droplet ejection volume of the juncture region nozzles in the liquid droplet ejection head having the plurality of nozzles arranged in the two-dimensional configuration (matrix array), it is possible to reduce the visibility of density non-uniformity occurring in the juncture regions.

If the matrix type head is constituted by a full line type head, then the first direction is the main scanning direction, which is a direction substantially perpendicular to the relative conveyance direction of the recording medium with respect to the head, and the second direction is the sub-scanning direction, which is the relative conveyance direction of the recording medium with respect to the head.

Furthermore, if the matrix type head is a serial type head, then the second direction is the main scanning direction which is the scanning direction of the head (the breadthways direction of the recording medium), and the first direction is the sub-scanning direction, which is the relative conveyance direction of the recording medium with respect to the head.

Preferably, a first nozzle row of the nozzles in the oblique direction and a second nozzle row of the nozzles in the oblique direction are mutually adjacent in the first direction; the first nozzle is at an end of the first nozzle row on a side adjacent to the second nozzle row; and the second nozzle is at an end of the second nozzle row on a side adjacent to the first nozzle row.

According to this aspect of the present invention, by correcting the liquid droplet ejection volume of the juncture region nozzles corresponding to at least one of the first nozzle at the end of the first nozzle row on the side adjacent to the second nozzle row, and the second nozzle at the end of the second nozzle row on the side adjacent to the first nozzle row, it is possible to reduce the visibility of density non-uniformity occurring in the juncture region, which is the junction section between the first nozzle row and the second nozzle row.

Preferably, the liquid droplet volume adjustment device corrects a liquid droplet ejection volume of a juncture region adjacent nozzle corresponding to at least one of the nozzles adjacent to the juncture region nozzle.

According to this aspect of the present invention, it is possible further to reduce the visibility of density non-uniformity caused by the correction of the liquid droplet ejection volume of the juncture region nozzles.

Preferably, the liquid droplet volume adjustment device corrects the liquid droplet ejection volume of the juncture region nozzle with a correction coefficient having an absolute correction rate, and corrects the liquid droplet ejection volume of the juncture region adjacent nozzle with another correction coefficient having another absolute correction rate that is smaller than the absolute correction rate of the correction coefficient for the juncture region nozzle.

According to this aspect of the present invention, the absolute correction rate applied to the juncture region adjacent nozzle is smaller than the absolute correction rate applied to the juncture region nozzle, in such a manner that the visibility of density non-uniformity caused by correction of the liquid droplet ejection volume of the juncture region nozzle can be reduced in a smooth fashion.

Preferably, the liquid droplet volume adjustment device applies the correction coefficient having largest one of the absolute correction rates to the juncture region nozzle, and applies the correction coefficient having smaller one of the absolute correction rates to the juncture region adjacent nozzle, as a distance from the juncture region nozzle to the juncture region adjacent nozzle larger.

According to this aspect of the present invention, the absolute correction rate applied to the juncture region adjacent nozzle is made smaller, the greater the distance from the juncture region nozzle, in such a manner that the visibility of density non-uniformity caused by correction of the liquid droplet ejection volume of the juncture region nozzle can be reduced in a smooth fashion.

Preferably, the liquid droplet volume adjustment device corrects the liquid droplet ejection volumes in opposite phases for the juncture region nozzle and the juncture region adjacent nozzle.

According to this aspect of the present invention, the correction applied to the juncture region nozzle is implemented in an opposite phase to the correction applied to the juncture region adjacent nozzle. In other words, desirably, if correction is performed so as to increase the liquid droplet ejection volume of the juncture region nozzle, then correction is performed so as to decrease the liquid droplet ejection volume of the juncture region adjacent nozzle, whereas if correction is performed so as to decrease the liquid droplet ejection volume of the juncture region nozzle, then correction is performed so as to increase the liquid droplet ejection volume of the juncture region adjacent nozzle. Therefore, it is possible to reduce the visibility of density non-uniformity caused by correction of the liquid droplet ejection volume of the juncture region nozzle, in a smooth fashion.

Preferably, the first direction is a main scanning direction which is substantially perpendicular to a relative conveyance direction of a recording medium with respect to the liquid droplet ejection head; and the second direction is a sub-scanning direction which coincides with the relative conveyance direction of the recording medium with respect to the liquid droplet ejection head.

According to this aspect of the present invention, it is possible to reduce the visibility of density non-uniformity occurring in the main scanning direction in the juncture regions.

Preferably, the nozzles are arranged in the projected nozzle row at regular intervals.

According to this aspect of the present invention, dots can be formed in the first direction at the regular intervals, thus facilitating image processing.

Preferably, the liquid droplet ejection apparatus further comprises: a head angle determination device which determines a head angle of the liquid droplet ejection head with respect to a prescribed direction, wherein the liquid droplet volume adjustment device adjusts the liquid droplet ejection volume of the juncture region nozzle and/or the liquid droplet ejection volume of the juncture region adjacent nozzle according to the head angle determined by the head angle determination device.

According to this aspect of the present invention, by correcting the liquid droplet ejection volume of the juncture region nozzle and/or the juncture region adjacent nozzle on the basis of the head angle, it is possible reliably to reduce the visibility of density non-uniformity occurring in juncture regions.

Preferably, the prescribed direction is the second direction (the relative conveyance direction of the recording medium).

Preferably, the liquid droplet ejection apparatus further comprises: a test pattern creating device which creates a test pattern by the liquid droplet ejection head; and a density distribution measurement device which measures a density distribution on the test pattern, wherein the liquid droplet ejection volume of the juncture region nozzle and/or the liquid droplet ejection volume of the juncture region adjacent nozzle is adjusted according to the density distribution on the test pattern measured by the density distribution measurement device.

According to this aspect of the present invention, by correcting the liquid droplet ejection volume of juncture region nozzles and/or the liquid droplet ejection volume of the juncture region adjacent nozzle on the basis of the density distribution of the test pattern, it is possible reliably to reduce the visibility of density non-uniformity occurring in the juncture regions.

Preferably, the liquid droplet volume adjustment device adjusts the liquid droplet ejection volume of the juncture region nozzle according to an output density of an image.

According to this aspect of the present invention, it is possible to achieve highly precise correction in accordance with the output density of the image, and it is therefore possible further to reduce the visibility of density non-uniformity occurring in the juncture regions.

In order to attain the aforementioned object, the present invention is also directed to an image recording method using the above-described liquid droplet ejection apparatus, wherein an image is recorded while adjusting the liquid droplet ejection volume of the juncture region nozzle.

In order to attain the aforementioned object, the present invention is also directed to an image recording method using the above-described liquid droplet ejection apparatus, wherein an image is recorded while adjusting the liquid droplet ejection volume of the juncture region nozzle according to the head angle determined by the head angle determination device.

In order to attain the aforementioned object, the present invention is also directed to an image recording method using the above-described liquid droplet ejection apparatus, wherein an image is recorded while adjusting the liquid droplet ejection volume of the juncture region nozzle according to the density distribution on the test pattern measured by the density distribution measurement device.

According to the present invention, by arranging third at least one nozzle in the substantially central position between the first nozzle and the second nozzle in the juncture region in the liquid droplet ejection head having the plurality of nozzle arranged two-dimensionally (in the matrix configuration), or by correcting the liquid droplet ejection volume of the juncture region nozzles in the liquid droplet ejection head having the plurality of nozzles arranged two-dimensionally (in the matrix configuration), then the nozzle pitch in the second direction in the juncture region becomes smaller, and the visibility of density non-uniformity occurring in the juncture regions can be reduced.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIGS. 16A and 16B are illustrative diagrams showing examples adjustment data tables according to the first embodiment;

FIG. 17 is an illustrative diagram showing an example of a head angle table according to the first embodiment;

FIGS. 26A and 26B are illustrative diagrams showing examples adjustment data tables according to the second embodiment;

FIG. 27 is an illustrative diagram showing an example of ejection volume correction table according to the second embodiment;

FIG. 28 is an illustrative diagram showing an example of ejection volume correction table according to a modification of the second embodiment;

DETAILED DESCRIPTION OF THE PREFERRED EMBODIMENTS

First Embodiment

General Composition of Inkjet Recording Apparatus

Figure 1:
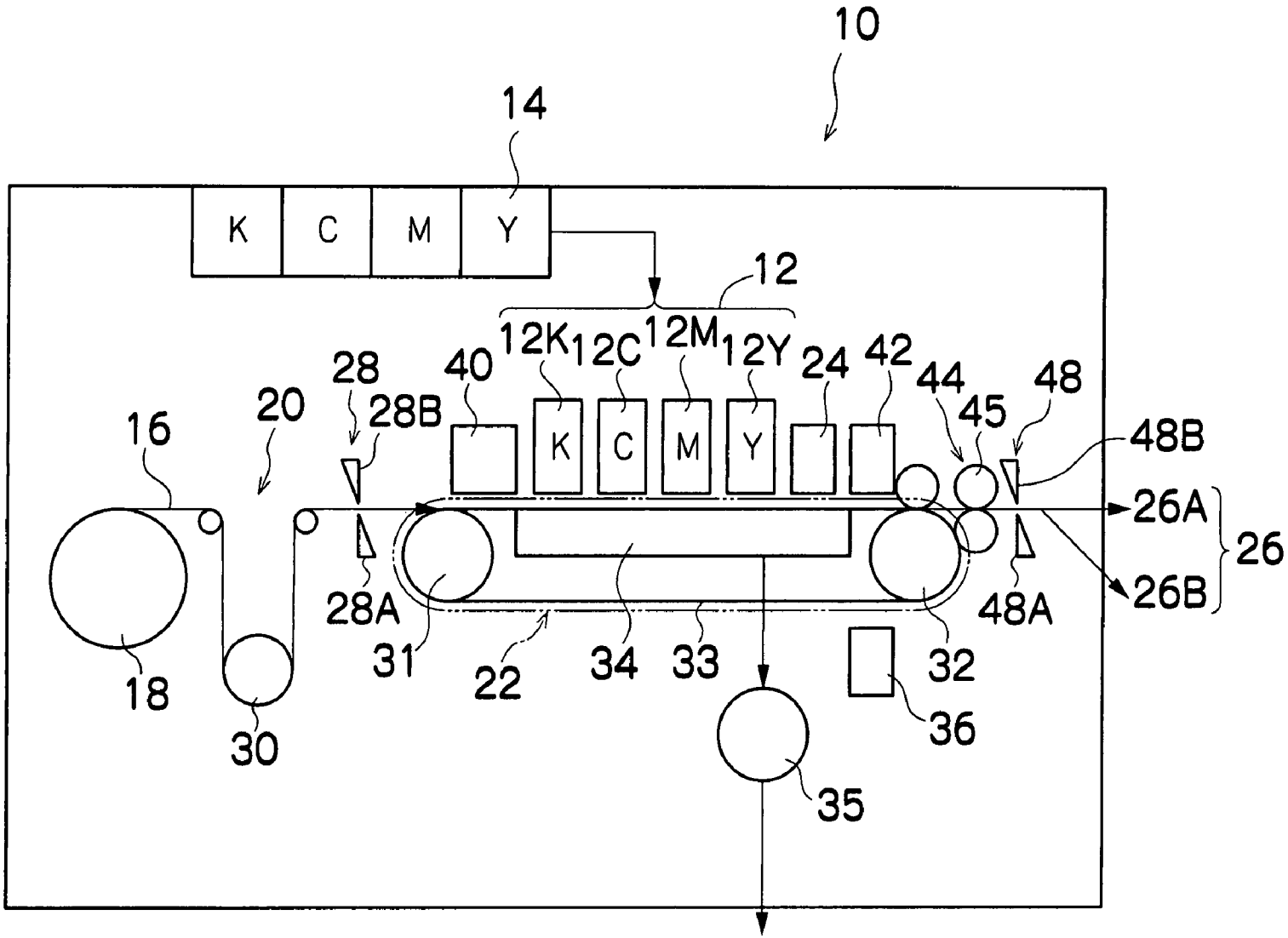
FIG. 1 is a general schematic drawing of an inkjet recording apparatus forming an image forming apparatus according to an embodiment of the present invention.

FIG. 1 is a general schematic drawing of an inkjet recording apparatus forming an embodiment of an image forming apparatus to which the present invention is applied. As shown in FIG. 1, the inkjet recording apparatus 10 comprises: a print unit 12 having a plurality of print heads 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the print unit 12; and a paper output unit 26 for outputting image-printed recording paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the print unit 12 and the sensor face of the print determination unit 24 forms a plane (flat plane).

The belt 33 has a width that is greater than the width of the recording paper 16, and a plurality of suction restrictors (not shown) are formed on the belt surface. A suction chamber 34 is disposed in a position facing the sensor surface of the print determination unit 24 and the nozzle surface of the print unit 12 on the interior side of the belt 33, which is set around the rollers 31 and 32, as shown in FIG. 1; and a negative pressure is generated by sucking air from the suction chamber 34 by means of a fan 35, thereby the recording paper 16 on the belt 33 is held by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the print unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
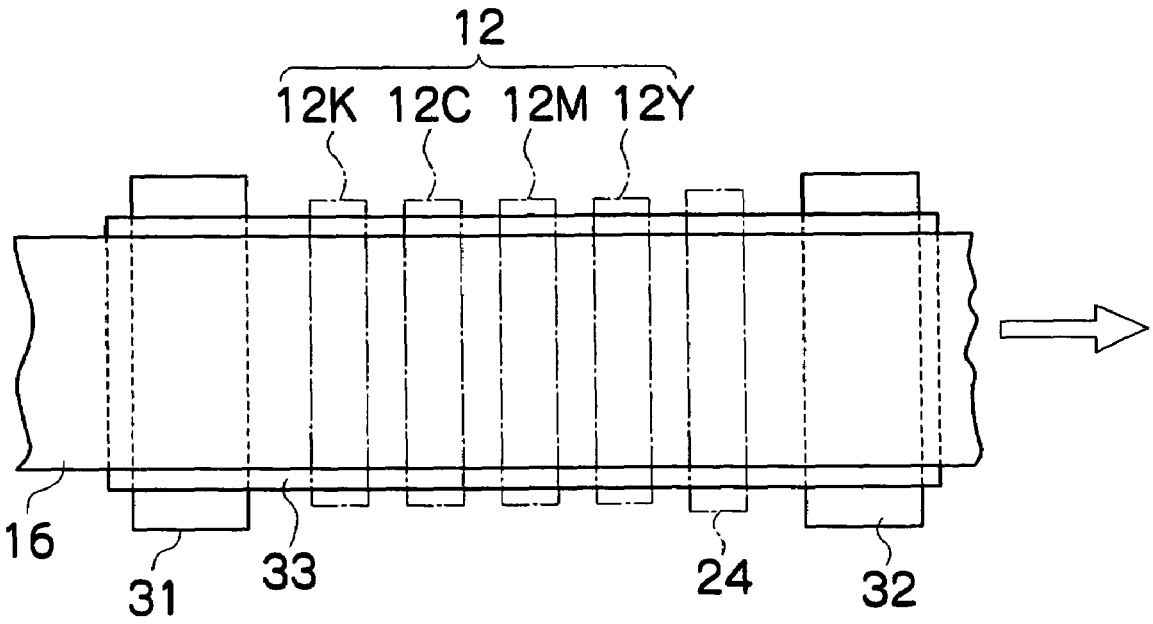
FIG. 2 is a plan view of the principal part of the peripheral area of a print unit in the inkjet recording apparatus shown in FIG. 1.

As shown in FIG. 2, the print unit 12 is a so-called "full line head" in which a line head having a length corresponding to the maximum paper width is arranged in a direction (main scanning direction) that is perpendicular to the paper conveyance direction (sub-scanning direction). Each of the print heads 12K, 12C, 12M, and 12Y configuring the print unit 12 is constituted by a line head, in which a plurality of ink ejection ports (nozzles) are arranged along a length that exceeds at least one side of the maximum-size recording paper 16 intended for use in the inkjet recording apparatus 10, and the structure is described in detail with reference to FIGS. 3 to 5 later.

The print heads 12K, 12C, 12M, and 12Y are arranged in the order of black (K), cyan (C), magenta (M), and yellow (Y) from the upstream side (the left-hand side in FIG. 1), along the conveyance direction of the recording paper 16 (paper conveyance direction). A color image can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relative to each other in the paper conveyance direction (sub-scanning direction) just once (in other words, by means of a single sub-scan). Higher-speed printing is thereby made possible and productivity can be improved in comparison with a shuttle type head configuration in which a print head moves reciprocally in the direction (main scanning direction) which is perpendicular to the paper conveyance direction.

Although a configuration with the KCMY four standard colors is described in the present embodiment, the combinations of the ink colors and the number of colors are not limited to these, and light and/or dark inks can be added as required. For example, a configuration is possible in which print heads for ejecting light-colored inks such as light cyan and light magenta are added.

As shown in FIG. 1, the ink storing and loading unit 14 has ink tanks for storing the inks of the colors corresponding to the respective print heads 12K, 12C, 12M, and 12Y, and the respective tanks are connected to the print heads 12K, 12C, 12M, and 12Y by means of channels (not shown). The ink storing and loading unit 14 has a warning device (for example, a display device, an alarm sound generator, or the like) for warning when the remaining amount of any ink is low, and has a mechanism for preventing loading errors among the colors.

The print determination unit 24 has an image sensor (line sensor) for capturing an image of the ink-droplet deposition result of the print unit 12, and functions as a device to check for ejection defects such as clogs of the nozzles in the print unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the print heads 12K, 12C, 12M, and 12Y for the respective colors, and the ejection of each head is determined. The ejection determination includes the presence of the ejection, measurement of the dot size, and measurement of the dot deposition position.

The print determination unit 24 measures the density distribution of test patterns, in order to determine an adjusted liquid droplet ejection volume for central nozzles provided in juncture regions, of which detailed descriptions are given later.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown, the paper output unit 26A for the target prints is provided with a sorter for collecting prints according to print orders.

Next, the structure of a print head is described. The print heads 12K, 12C, 12M and 12Y of the respective ink colors have the same structure, and a reference numeral 50 is hereinafter designated to any of the print heads.

Figure 3:
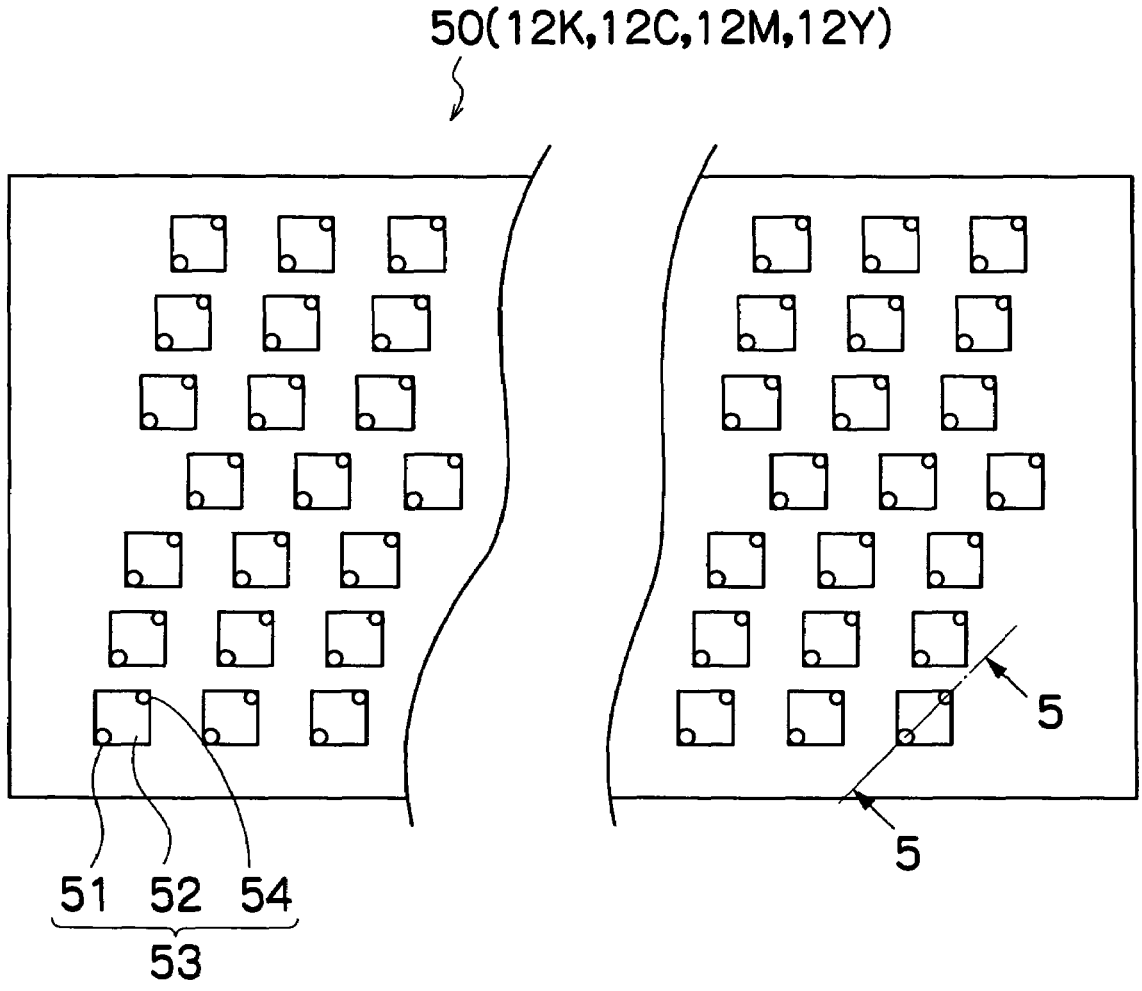
FIG. 3 is a plan perspective diagram showing an example of the structure of a print head.

FIG. 3 is a plan view perspective diagram showing the example of the structure of a print head 50. In order to achieve a high resolution of the dots printed onto the surface of the recording medium, it is necessary to reduce the nozzle pitch in the print head 50. As shown in FIG. 3, the print head 50 according to the present embodiment has a structure in which a plurality of ink chamber units 53, comprising nozzles 51 for ejecting ink droplets and pressure chambers 52 corresponding to the nozzles 51, are disposed (two-dimensionally) in the form of a staggered matrix, and the effective nozzle pitch is thereby made small.

The planar shape of the pressure chamber 52 provided for each nozzle 51 is substantially a square, and the nozzle 51 and supply port 54 are disposed in both corners on a diagonal line of the square.

Figure 4:
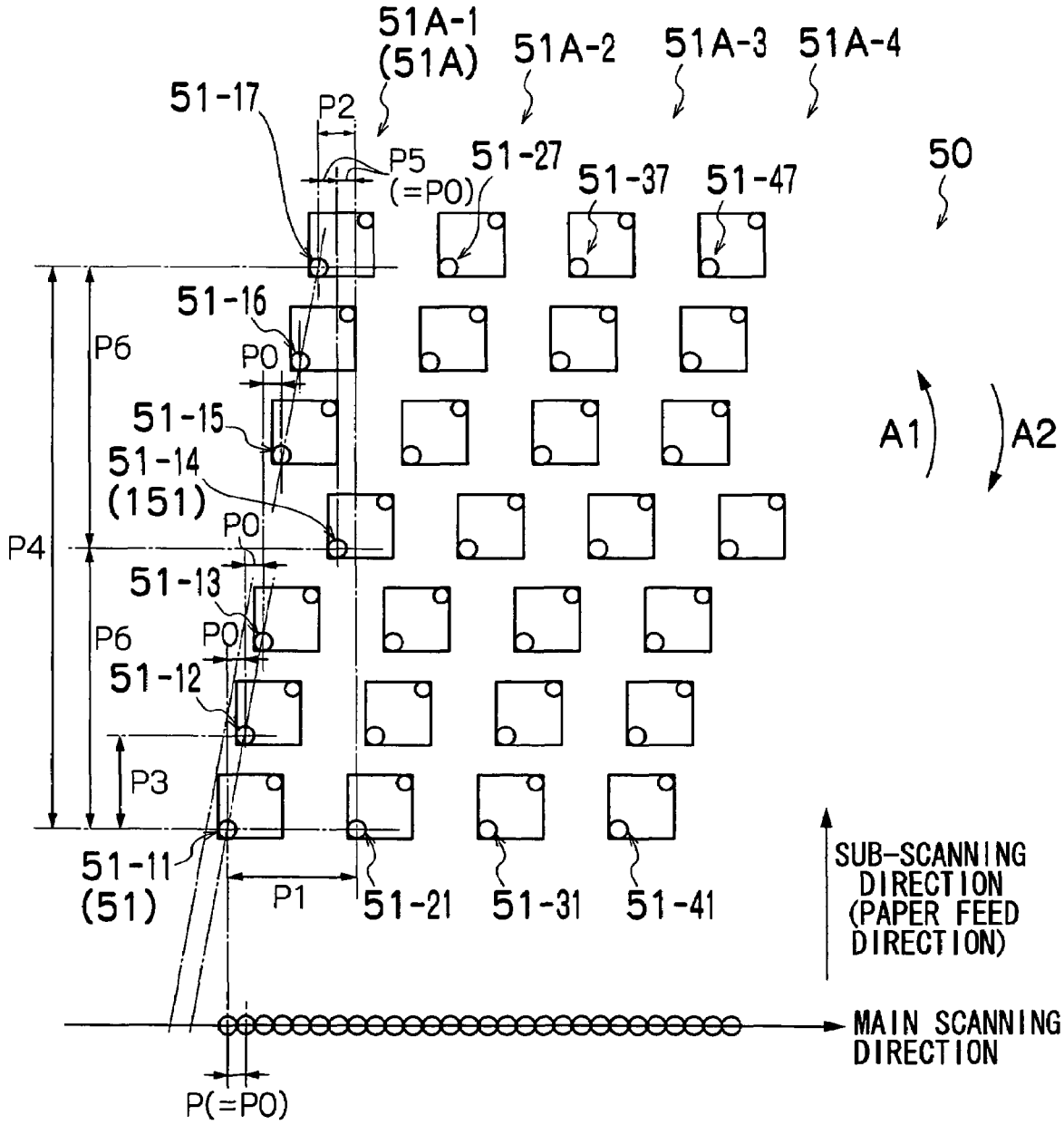
FIG. 4 is an enlarged view showing an example of the nozzle arrangement in the print head shown in FIG. 3.

FIG. 4 is an enlarged view showing an embodiment of the nozzle arrangement in the print head 50 shown in FIG. 3. In FIG. 4, similarly to FIG. 30, P0 is taken to be the pitch of the nozzles in the main scanning direction, P1 is taken to be the pitch of the nozzles that are mutually adjacent in the main scanning direction (in other words, the pitch of the nozzles that eject droplets at the same timing), P2 is taken to be the pitch of the nozzles in the main scanning direction in the juncture region (the junction section between nozzle rows), P3 is taken to be the pitch of the nozzles in the sub-scanning direction (the paper feed direction), and P4 is taken to be the pitch of the nozzles in the sub-scanning direction in the juncture region (the junction section between nozzle rows).

As shown in FIG. 4, the print head 50 according to the present embodiment has a structure in which a plurality of nozzles 51 (ink chamber units 53) are arranged at a fixed arrangement pattern in a row direction which follows the main scanning direction, and an oblique column direction which is not perpendicular to the main scanning direction. For example, the nozzle row 51A-1 arranged in the oblique column direction is constituted by the seven nozzles, 51-11 to 51-17, and the other nozzle rows 51A-2, 51A-3, 51A-4, and so on, distributed in the main scanning direction have the same structure.

The juncture region (nozzle row junction section) is the boundary (junction section) between nozzle rows 51 A that are mutually adjacent in the main scanning direction, and is, for example, the region between the nozzle 51-17 in the nozzle row 51A-1 and the nozzle 51-21 in the nozzle row 51A-2. The juncture region nozzles are the nozzles at the ends of the nozzle rows in the oblique column direction in a juncture region, and are, for example, the nozzles 51-17 and 51-21. The distance between the juncture region nozzles 51-17 and 51-21 is P2 and P4 in the main scanning direction and the sub-scanning direction, respectively.

In the present embodiment, a central nozzle 151 is disposed in an approximately central position between the juncture region nozzles 51-17 and 51-21. A nozzle 51-14 constituting a portion of the nozzle row 51A-1 serves as the central nozzle 151, and is shifted from the position of the nozzle 51-14 shown in FIG. 30, toward the downstream side in the main scanning direction (toward the right-hand side in FIG. 4). This central nozzle 151 is disposed in an approximately central position between the juncture region nozzles 51-17 and 51-21, in terms of both the sub-scanning direction and the main scanning direction. Furthermore, in conjunction with this, the nozzles 51-15, 51-16 and 51-17, which constitute a portion of the nozzle row 51A-1, are shifted toward the upstream side in the main scanning direction (the left-hand side in FIG. 4).

Figure 30:
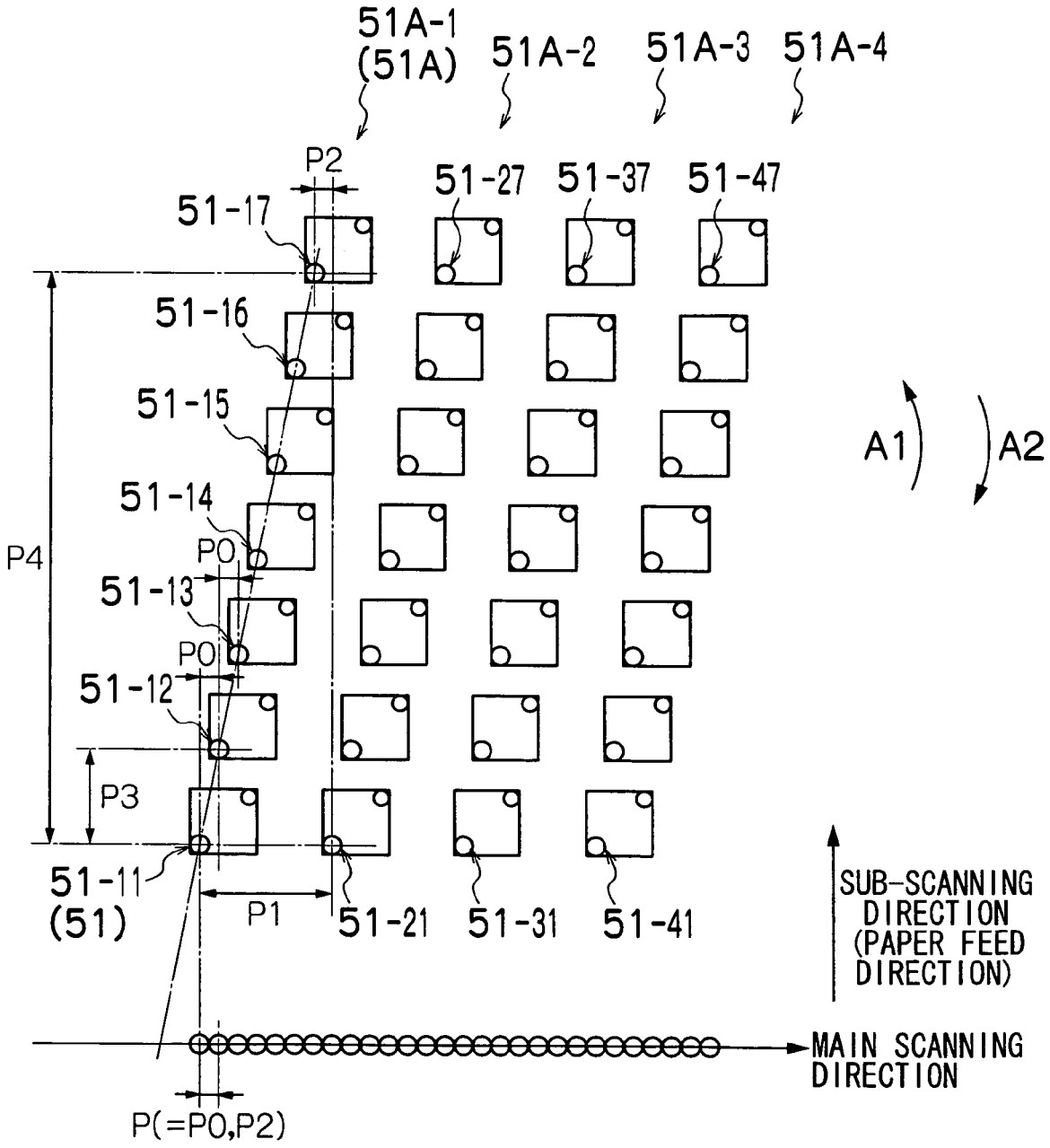
FIG.30 RELATED ART
FIG. 30 is an illustrative diagram showing a nozzle arrangement in a print head in the related art.

To give a more detailed description, the central nozzle 151 (51-14) shown in FIG. 4 is achieved by shifting the position of the nozzle 51-14 shown in FIG. 30, to the downstream side in the main scanning direction, by a distance corresponding to the nozzle pitch P0 in the main scanning direction multiplied by the number of nozzles 51-15, 51-16 and 51-17, which are shifted in position toward the upstream side in the main scanning direction, which is 3 nozzles in this case (i.e., by a distance of P0×3). On the other hand, the nozzles 51-15, 51-16 and 51-17 shown in FIG. 4 are achieved by shifting the positions of the nozzles 51-15, 51-16 and 51-17 shown in FIG. 30, toward the upstream side in the main scanning direction, by a distance equal to the nozzle pitch P0 in the main scanning direction.

By means of this nozzle arrangement, the nozzle pitch in the main scanning direction between the juncture region nozzles 51-17 and 51-21 (namely, the nozzle pitch in the main scanning direction in the juncture regions) P2, becomes twice the nozzle pitch P0 in the main 5 scanning direction in the other regions, and the central nozzle 151 (51-14) is situated between the juncture region nozzles 51-17 and 51-21 in a central position in the main scanning direction. Therefore, when projected so as to align in the main scanning direction, the juncture region nozzle 51-17, the central nozzle 151 (51-14) and the juncture region nozzle 51-21 are situated at regular intervals at a nozzle pitch of P5 (=P0) in the main scanning direction.

Furthermore, since the nozzle pitch in the main scanning direction between the nozzles 51-13 and 51-15 becomes P0, then the nozzles 51-11, 51-12, 51-13, 51-15, 51-16 and 51-17 are arranged at regular intervals at a nozzle pitch of P0 in the main scanning direction. A nozzle arrangement similar to that of the nozzle row 51A-1 is also adopted in the other nozzle rows 51A-2, 51A-3, 51A-4, and so on, which are arranged in the main scanning direction.

Therefore, when projected so as to align in the main scanning direction, the nozzles 51 are arranged at regular intervals at the nozzle pitch of P0, and hence a row of dots arranged at regular intervals at a dot pitch of P (=P0) is formed on the recording paper 16 in the main scanning direction, as shown in the lower part of FIG. 4.

By arranging one of the nozzles 51 forming a portion of the nozzle row 51 A at a position shifted in the main scanning direction, as in the case of the central nozzle 151, it is possible to achieve the nozzle arrangement of the print head 50 according to the embodiment of the present invention, without affecting the ejection characteristics, such as the volume or flight speed of the ejected liquid droplets, of the nozzles 51 provided in the print head 50. The invention is not limited to a mode in which one of the nozzles 51 forming a nozzle row 51A, such as the central nozzle 151, is shifted in position in the main scanning direction, and it is also possible to add a new central nozzle 151 that is not related to the nozzle row 51A.

In this way, the print head 50 according to the present embodiment can be treated equivalently to a head in which the nozzles 51 are arranged in a linear fashion at a uniform pitch P0, in the main scanning direction. By means of this composition, it is possible to achieve a nozzle composition of high density, in which the nozzle rows projected so as to align in the main scanning direction reach a total of 2,400 per inch (2,400 nozzles per inch).

In a full-line head comprising rows of nozzles corresponding to the entire width of the paper, the "main scanning" is defined as printing a line formed of a row of dots, or one line formed of a plurality of rows of dots in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 51 arranged in a matrix such as that shown in FIG. 4 are driven, the main scanning according to the above-described (3) is preferred. More specifically, the nozzles 51-11, 51-12, 51-13, 51-14, 51-15, 51-16, 51-17 are treated as a block (additionally; the nozzles 51-21, . . . , 51-27 are treated as another block; the nozzles 51-31, . . . , 51-37 are treated as another block; . . . ); and one line is printed in the width direction of the recording paper 16 by sequentially driving the nozzles 51-11, 51-12, . . . , 51-17 in accordance with the conveyance velocity of the recording paper 16.

On the other hand, "sub-scanning" is defined as to repeatedly perform printing of one line formed of a row of dots, or a line formed of a plurality of rows of dots formed by the main scanning, while moving the full-line head and the recording paper relatively to each other.

Furthermore, in the print head 50 according to the present embodiment, the nozzle pitch P6 in the sub-scanning direction between the juncture region nozzle 51-17, the central nozzle 151 (51-14), and the juncture region nozzle 51-21, which nozzles are sequenced when projected so as to align in the main scanning direction, is one half of the nozzle pitch P4 in the sub-scanning direction between the juncture region nozzles 51-17 and 51-21. In other words, the nozzle pitch in the sub-scanning direction in the juncture region is one half of that in the related art shown in FIG. 30. Therefore, even if the print head 50 is rotated in the direction shown by arrow A1 or A2 in FIG. 4 when it is installed, the visibility of the density non-uniformity caused by heightening and lowering of the density is reduced at the portions corresponding to the juncture regions of the dot rows formed in the main scanning direction, compared to the related art.

In the present embodiment, a desirable mode is described as being one where a single central nozzle is positioned between two juncture region nozzles, but in implementing the present invention, it is also possible to dispose a plurality of central nozzles between the two juncture region nozzles.

Furthermore, in the print head 50 according to the present embodiment, it is possible further to reduce the visibility of density non-uniformity occurring in the juncture regions, by controlling droplet ejection in order to adjust the liquid droplet ejection volume of the central nozzle 151. The droplet ejection control method for the print head 50 is described later in detail.

Figure 5:
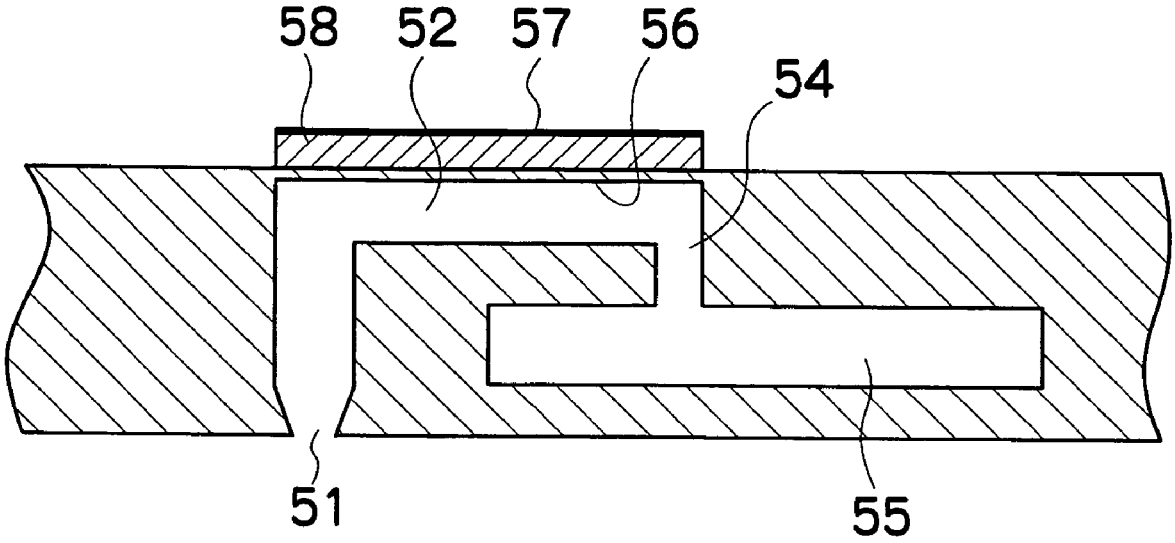
FIG. 5 is a cross-sectional diagram along line 5-5 in FIG. 3.

FIG. 5 is a cross-sectional diagram along line 5-5 in FIG. 3, and it shows the three-dimensional composition of the ink chamber unit 53. As shown in FIG. 5, the pressure chamber 52 is connected at one end to the nozzle 51 and it is connected at the other end to a common flow channel 55 through the supply port 54. Furthermore, the common flow channel 55 is connected to an ink tank 60 (not shown in FIG. 5, but shown in FIG. 6), which is a base tank for supplying ink, and the ink supplied from the ink tank 60 is supplied to the pressure chamber 52 through the common flow channel 55 shown in FIG. 5.

An actuator 58 provided with an individual electrode 57 is joined to a diaphragm 56, which forms the upper face of the pressure chamber 52 and also serves as a common electrode of the actuators 58. The actuator 58 is deformed when a drive voltage is supplied to the individual electrode 57, thereby causing an ink droplet to be ejected from the nozzle 51. When an ink droplet is ejected, new ink is supplied to the pressure chamber 52 from the common flow passage 55, through the supply port 54.

The method is employed in the present embodiment where an ink droplet is ejected by means of the deformation of the actuator 58, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Figure 6:
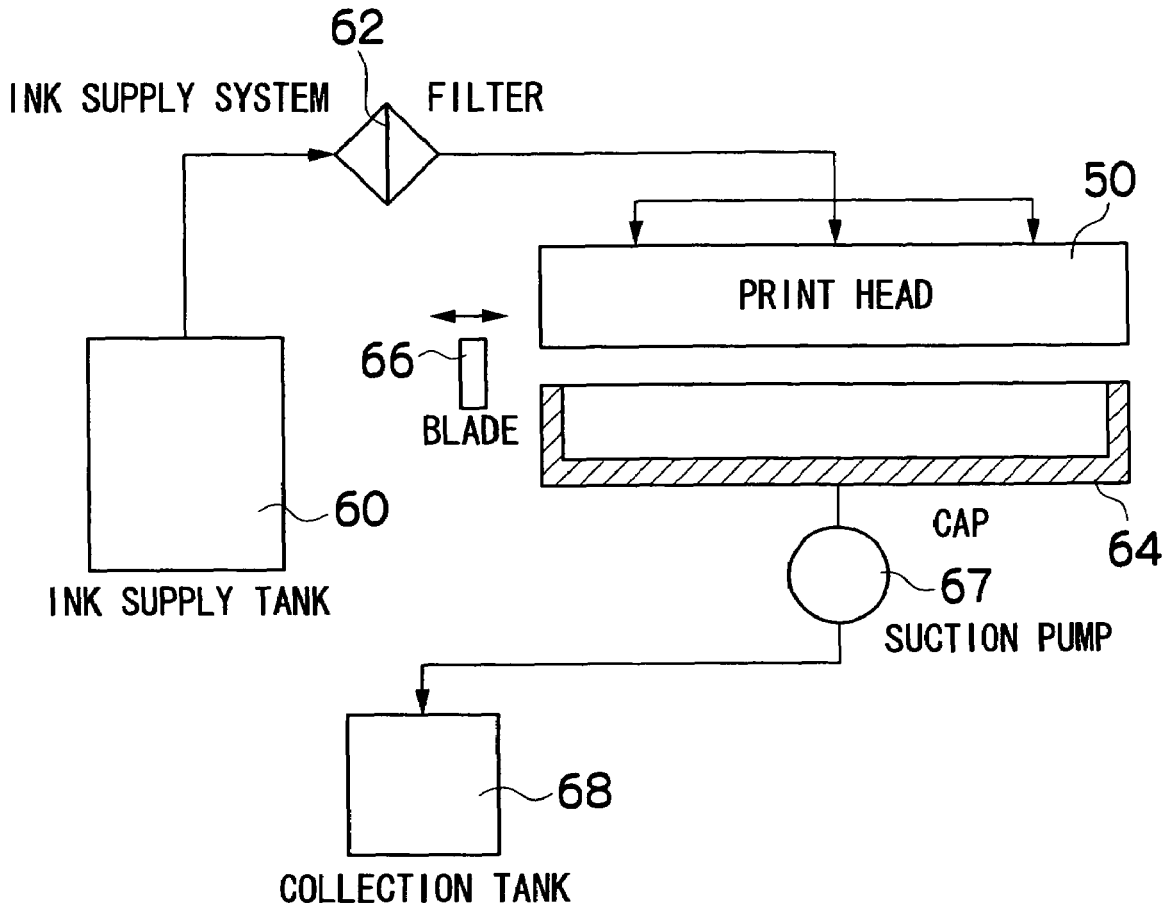
FIG. 6 is a schematic drawing showing the composition of an ink supply system in the inkjet recording apparatus.

FIG. 6 is a schematic drawing showing the configuration of the ink supply system in the inkjet recording apparatus 10.

The ink supply tank 60 is a base tank to supply ink and is set in the ink storing and loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink supply tank 60 in FIG. 6 is equivalent to the ink storing and loading unit 14 in FIG. 1 described above.

A filter 62 for removing foreign matters and bubbles is disposed between the ink supply tank 60 and the print head 50 as shown in FIG. 6. The filter mesh size in the filter 62 is preferably equivalent to or less than the diameter of the nozzle and commonly about 20 μm.

Although not shown in FIG. 6, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face.

A maintenance unit including the cap 64 and the cleaning blade 66 can be relatively moved with respect to the print head 50 by a movement mechanism (not shown), and is moved from a predetermined holding position to a maintenance position below the print head 50 as required.

The cap 64 is displaced up and down relatively with respect to the print head 50 by an elevator mechanism (not shown). When the power of the inkjet recording apparatus 10 is turned OFF or when in a print standby state, the cap 64 is raised to a predetermined elevated position so as to come into close contact with the print head 50, and the nozzle face is thereby covered with the cap 64.

During printing or standby, if the use frequency of a particular nozzle 51 is low, and if a state of not ejecting ink continues for a prescribed time period or more, then the solvent of the ink in the vicinity of the nozzle evaporates and the viscosity of the ink increases. In a situation of this kind, it will become impossible to eject ink from the nozzle 51, even if the actuator 58 is operated.

Therefore, before a situation of this kind develops (namely, while the ink is within a range of viscosity which allows it to be ejected by operation of the actuator 58), the actuator 58 is operated, and a preliminary ejection ("purge", "blank ejection", "liquid ejection" or "dummy ejection") is carried out toward the cap 64 (ink receptacle), in order to expel the degraded ink (namely, the ink in the vicinity of the nozzle which has increased viscosity).

Furthermore, if air bubbles enter into the ink inside the print head 50 (inside the pressure chamber 52), then even if the actuator 58 is operated, it will not be possible to eject ink from the nozzle 51. In a case of this kind, the cap 64 is placed on the print head 50, the ink (ink containing air bubbles) inside the pressure chamber 52 is removed by suction, by means of a suction pump 67, and the ink removed by suction is then supplied to a collection tank 68.

This suction operation is also carried out in order to remove degraded ink having increased viscosity (hardened ink), when ink is loaded into the head for the first time, and when the head starts to be used after having been out of use for a long period of time. Since the suction operation is carried out with respect to all of the ink inside the pressure chamber 52, the ink consumption is considerably large. Therefore, desirably, preliminary ejection is carried out when the increase in the viscosity of the ink is still minor.

The cleaning blade 66 is composed of rubber or another elastic member, and can slide on the ink ejection surface (surface of the nozzle plate) of the print head 50 by means of a blade movement mechanism (wiper) (not shown). When ink droplets or foreign matter has adhered to the nozzle plate, the surface of the nozzle plate is wiped and cleaned by sliding the cleaning blade 66 on the nozzle plate. When the soiling on the ink ejection surface is cleaned away by the blade mechanism, a preliminary ejection is also carried out in order to prevent the foreign matter from becoming mixed inside the nozzle 51 by the blade.

Figure 7:
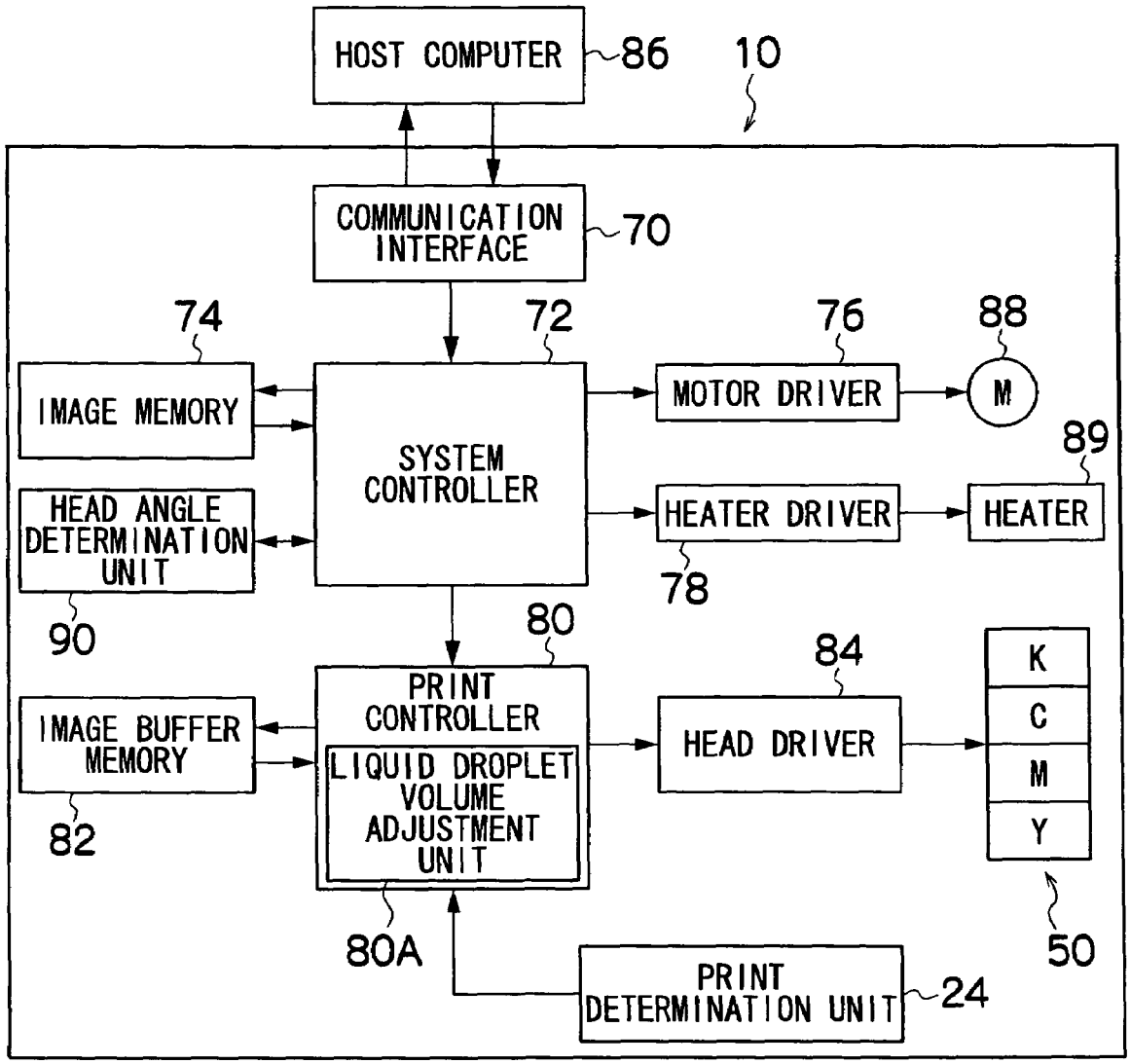
FIG. 7 is a principal block diagram showing the system composition of the inkjet recording apparatus.

FIG. 7 is a principal block diagram showing the system configuration of the inkjet recording apparatus 10. The inkjet recording apparatus 10 comprises a communication interface 70, a system controller 72, an image memory 74, a motor driver 76, a heater driver 78, a print controller 80, an image buffer memory 82, a head driver 84, a print determination unit 24, a head angle determination unit 90, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is a control unit for controlling the various sections, such as the communications interface 70, the image memory 74, the head angle determination unit 90, the motor driver 76, the heater driver 78, and the like. The system controller 72 is constituted by a central processing unit (CPU) and peripheral circuits thereof, and the like, and in addition to controlling communications with the host computer 86 and controlling reading and writing from and to the image memory 74, or the like, it also generates a control signal for controlling the motor 88 of the conveyance system and the heater 89.

The head angle determination unit 90 determines the angle of the print head 50 with respect to the paper feed direction (head angle), and sends the result to the system controller 72. The system controller 72 stores the head angle reported by the head angle determination unit 90 in a memory unit (not shown). Furthermore, the system controller 72 compares the head angle stored in the memory unit with the head angle reported by the head determination unit 90, and it reports the result to the print controller 80.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to supply the generated print control signals (print data) to the head driver 84. Prescribed signal processing is carried out in the print controller 80, and the ejection amount and the ejection timing of the ink droplets from the respective print heads 50 are controlled through the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 7 is one in which the image buffer memory 82 accompanies the print controller 80; however, the image memory 74 may also serve as the image buffer memory 82. Also possible is an aspect in which the print controller 80 and the system controller 72 are integrated to form a single processor.

A liquid droplet volume adjustment unit 80A is provided in the print controller 80, and this unit 80A adjusts the liquid droplet ejection volume of the central nozzle 151 in the juncture region.

The head driver 84 drives the actuators 58 (see FIG. 5) of the print heads 12K, 12C, 12M and 12Y of the respective colors on the basis of print data supplied by the print controller 80. The head driver 84 can be provided with a feedback control system for maintaining constant drive conditions for the print heads.

The image data to be printed is externally inputted through the communication interface 70, and is stored in the image memory 74. In this stage, for example, the RGB image data is stored in the image memory 74. The image data stored in the image memory 74 is sent to the print controller 80 through the system controller 72, and is converted into dot data for each ink color by a commonly known processing method, such as a dithering method or an error diffusion method, in the print controller 80.

The print head 50 is driven on the basis of the dot data thus generated by the print controller 80, so that ink is ejected from the head 50. By controlling ink ejection from the print head 50 in synchronization with the conveyance speed of the recording paper 16, an image is formed on the recording paper 16.

The print determination unit 24 is a block that includes the line sensor as described above with reference to FIG. 1, reads the image printed on the recording paper 16, determines the print conditions (presence of the ejection, variation in the dot formation, and the like) by performing desired signal processing, or the like, and provides the determination results of the print conditions to the print controller 80. The read start timing of the line sensor is determined from the distance between the sensor and the nozzle, and the conveyance speed of the recording paper 16. In the example shown in FIG. 1, the print determination unit 24 is provided on the print surface side, the print surface is irradiated with a light source (not shown), such as a cold cathode fluorescent tube disposed in the vicinity of the line sensor, and the reflected light is read in by the line sensor. However, in implementing the present invention, another composition may be adopted.

Furthermore, according to requirements, the print controller 80 makes various corrections with respect to the print head 50 on the basis of information obtained from the print determination unit 24. For example, the print controller 80 judges whether or not the nozzles 51 have performed ejection, on the basis of the determination information obtained by means of the print determination unit 24, and if the print controller 80 detects a nozzle that has suffered an ejection failure, then it implements control for performing a prescribed restoring operation.

In particular, in the present embodiment, the print determination unit 24 measures the density distribution of a test pattern and supplies the measurement result to the liquid droplet volume adjustment unit 80A. The liquid droplet volume adjustment unit 80A implements control for adjusting the liquid droplet ejection volume of the central nozzles 151 of the print head 50, through the head driver 84, on the basis of the measurement results for the density distribution of the test pattern supplied by the print determination unit 24.

Figure 8:
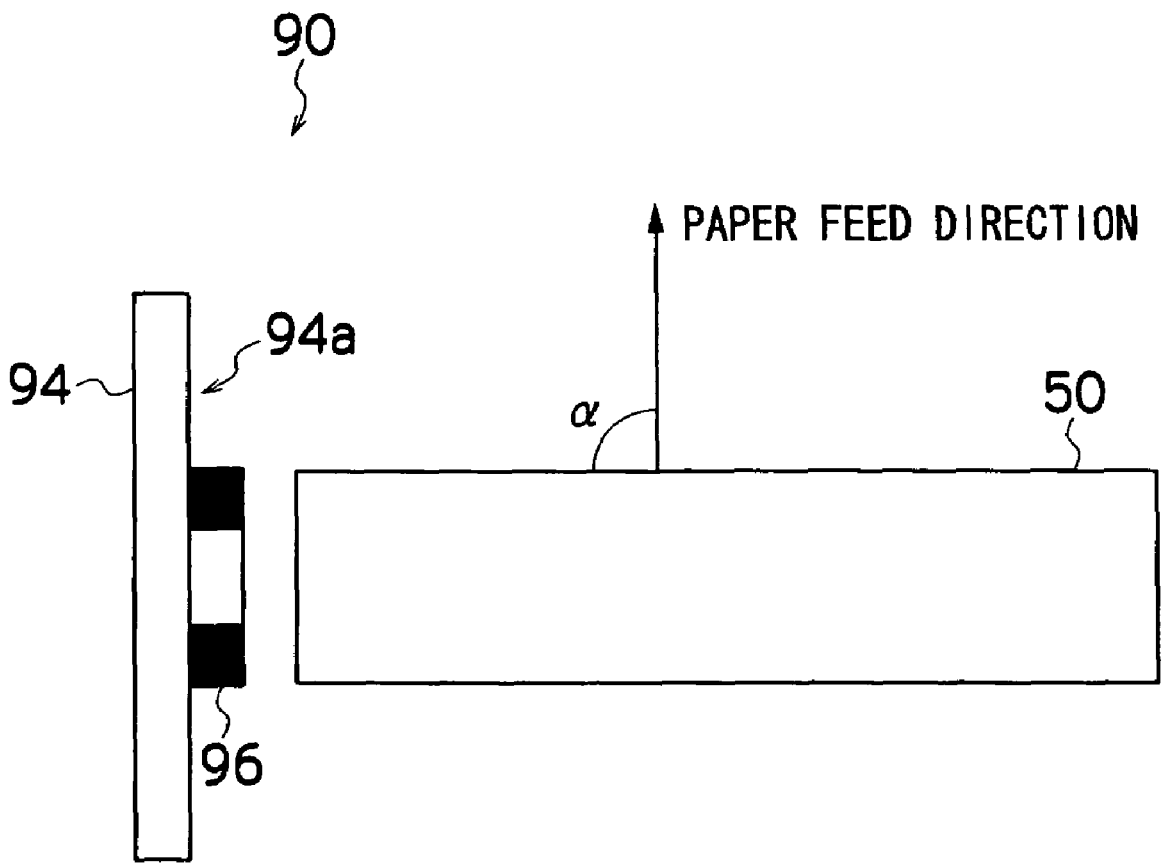
FIG. 8 is an illustrative diagram showing an example of the composition of a head angle determination unit.

FIG. 8 is an illustrative diagram showing an embodiment of the composition of the head angle determination unit 90 shown in FIG. 7. The head angle determination unit 90 is constituted by a gap sensor 96 arranged on the surface (gap sensor installation surface) 94a of a conveyance mechanism reference plate 94 on the side facing the print head 50. The conveyance mechanism reference plate 94 is fixed and positioned in line with the print head 50, and it is composed in such a manner that the gap sensor installation surface 94*a* of the conveyance mechanism reference plate 94 is parallel to the paper feed direction indicated by the arrow in FIG. 8.

The gap sensor 96 on the conveyance mechanism reference plate 94 is able to measure the gap to the print head 50, with high precision. Therefore, the angle between the lengthwise direction of the print head 50 and the paper feed direction (namely, the head angle) a, can be ascertained readily from the measurement value of the gap sensor 96. The head angle is not limited to the angle between the lengthwise direction of the print head 50 and the paper feed direction, and the head angle may also be taken as the angle between the breadthways direction of the print head 50, or another direction, and the paper feed direction, and furthermore, it is also possible to determine the variation in the paper feed direction, on each occasion. A commonly known sensor can be used as the gap sensor, and therefore description of the sensor is omitted here.

Droplet Ejection Control Method

Next, a method for controlling droplet ejection in the print head 50 according to the present embodiment is described.

Figure 9:
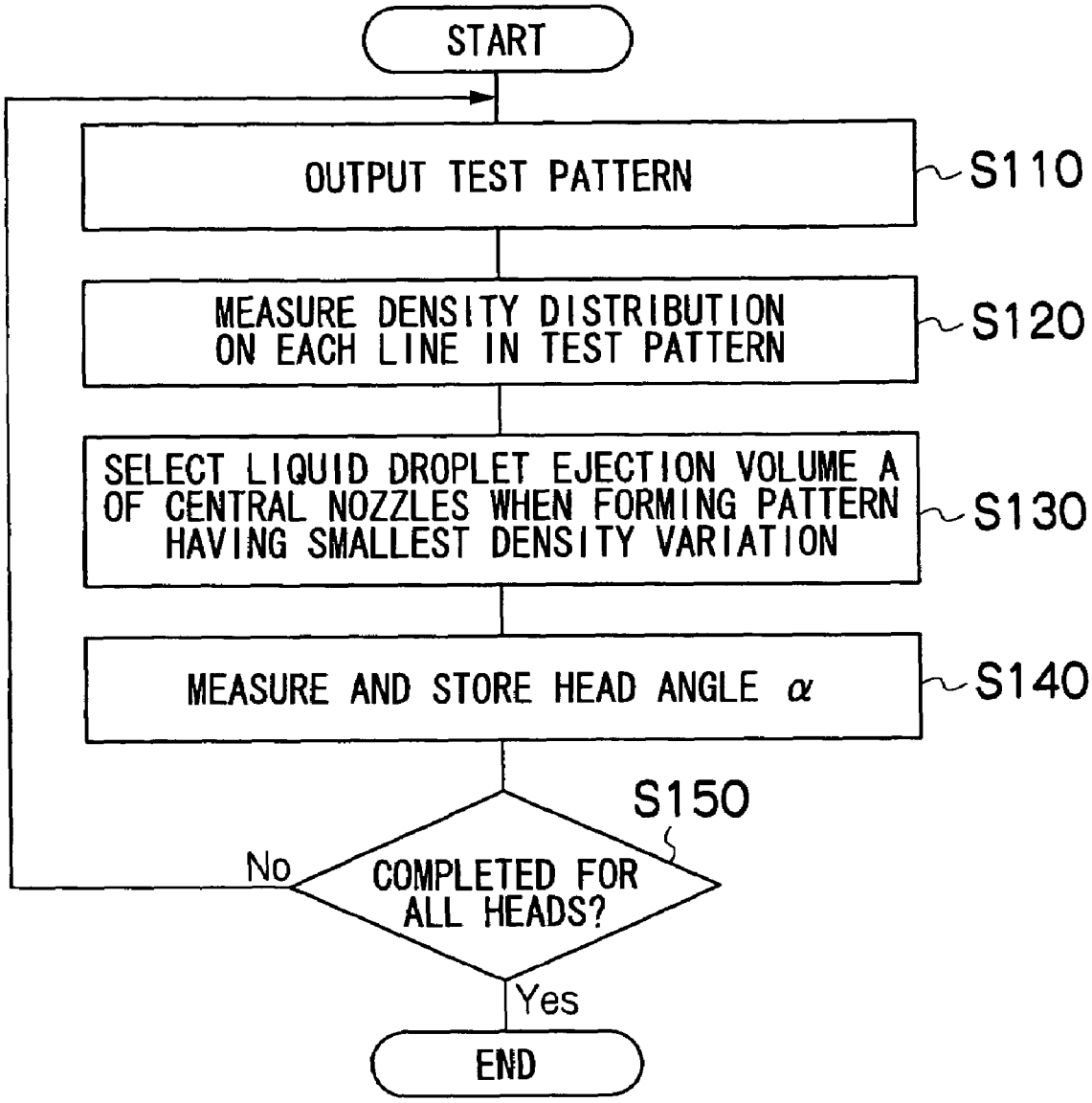
FIG. 9 is a flowchart showing an initial setting procedure for the print head according to the first embodiment.
Figure 10:
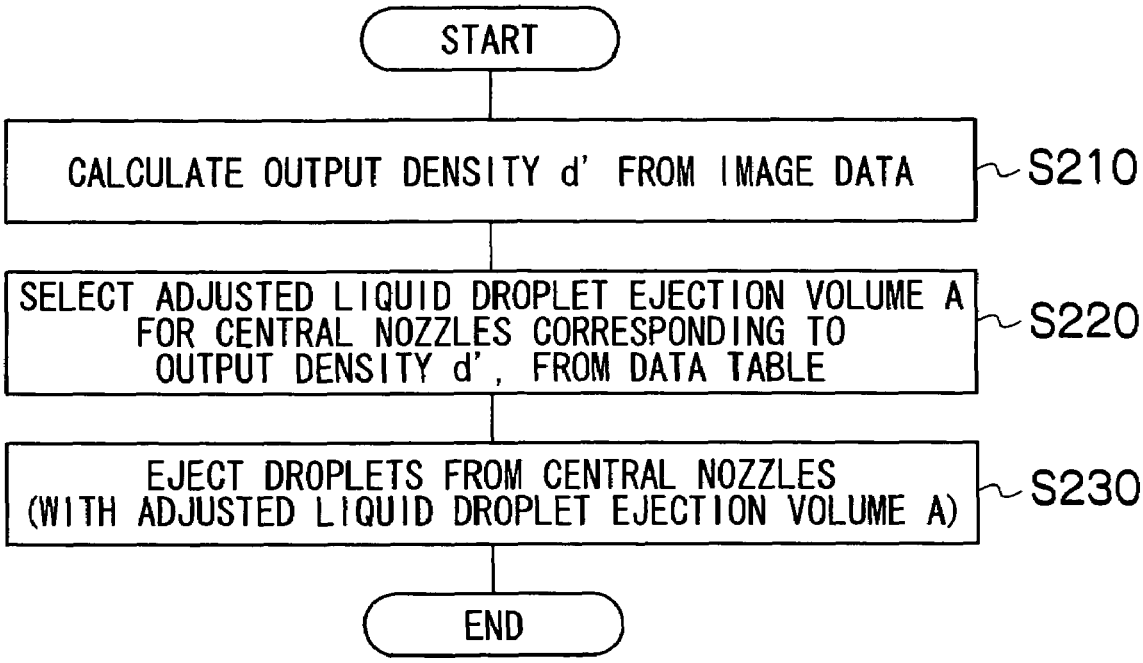
FIG. 10 is a flowchart showing a droplet ejection control procedure for the print head during a printing operation according to the first embodiment.
Figure 11:
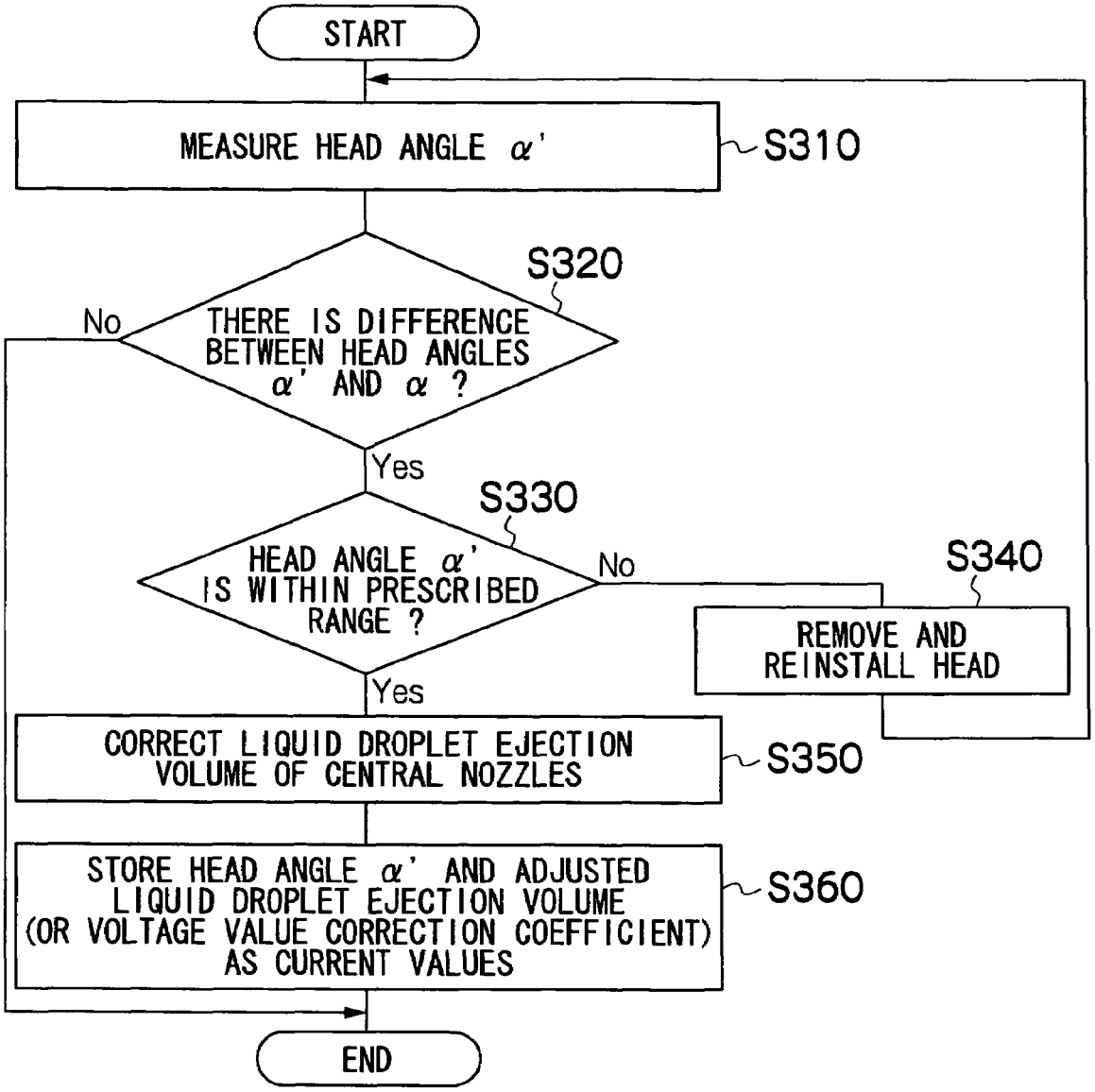
FIG. 11 is a flowchart showing a procedure of reinstalling the print head according to the first embodiment.

FIGS. 9 to 11 are flowcharts showing the droplet ejection control method for the print head 50 according to the present embodiment. Below, the droplet ejection control method is described with reference to the respective flowcharts.

FIG. 9 shows an initial setting procedure for the print head 50.

As shown in FIG. 9, firstly, test patterns are outputted to a sheet of recording medium 16, at respective output densities (step S110). In this case, a plurality of patterns are outputted while changing the liquid droplet ejection volumes of the central nozzles 151.

Figure 12:
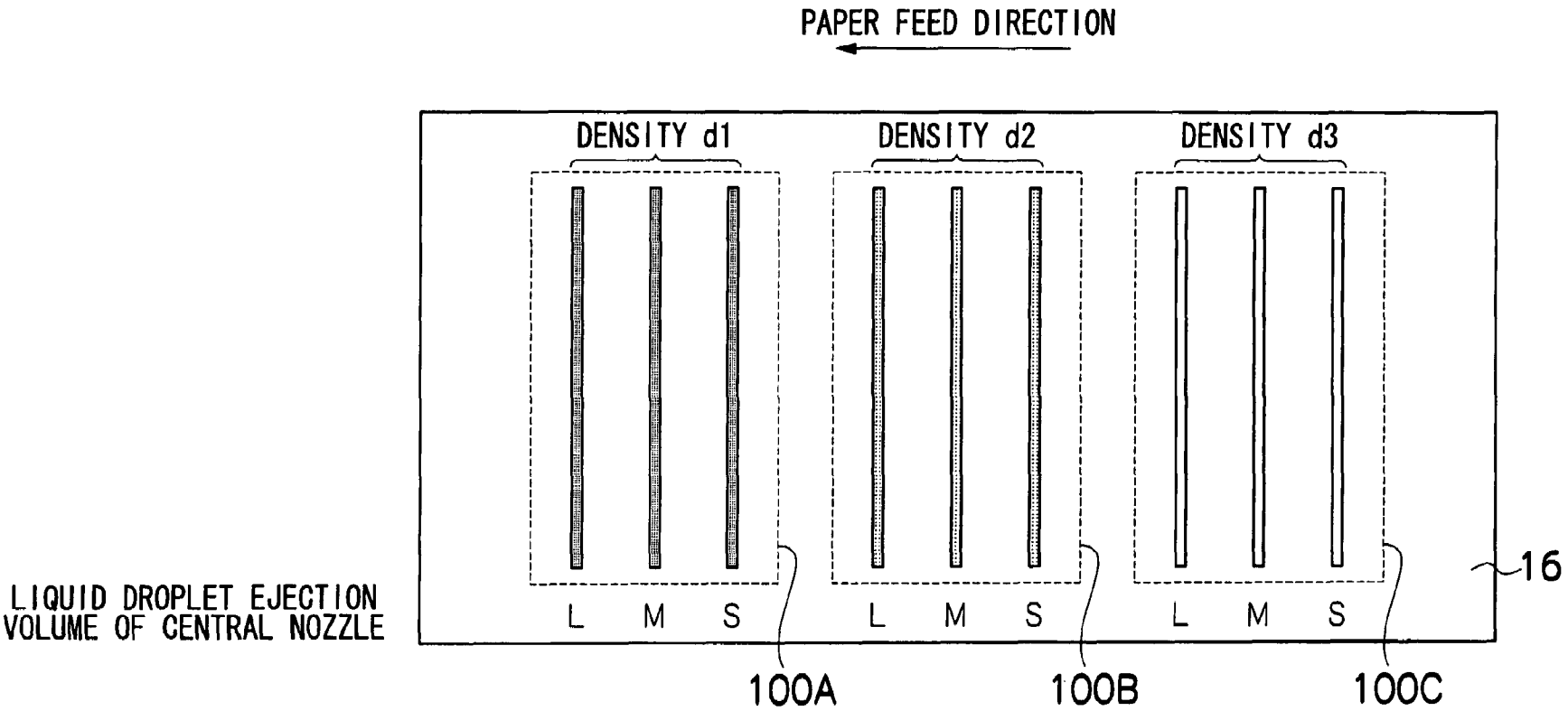
FIG. 12 is an illustrative diagram showing an example of a test pattern according to the first embodiment.

FIG. 12 shows an embodiment of the test patterns. As shown in FIG. 12, test patterns 100A, 100B and 100C are outputted respectively for output densities d1, d2 and d3. Each of the test patterns 100A, 100B and 100C is constituted by a plurality of straight lines in the main scanning direction perpendicular to the paper feed direction, which are outputted by changing the liquid droplet ejection volume of the central nozzles 151 in three stages (large/medium/small). The test patterns constituted by the straight lines extending in the main scanning direction are favorable for measuring variations in density in the main scanning direction. Furthermore, by forming the test patterns for the respective output densities, it is possible to adjust the liquid droplet ejection volume of the central nozzles 151 for each output density, as described later.

Figure 13:
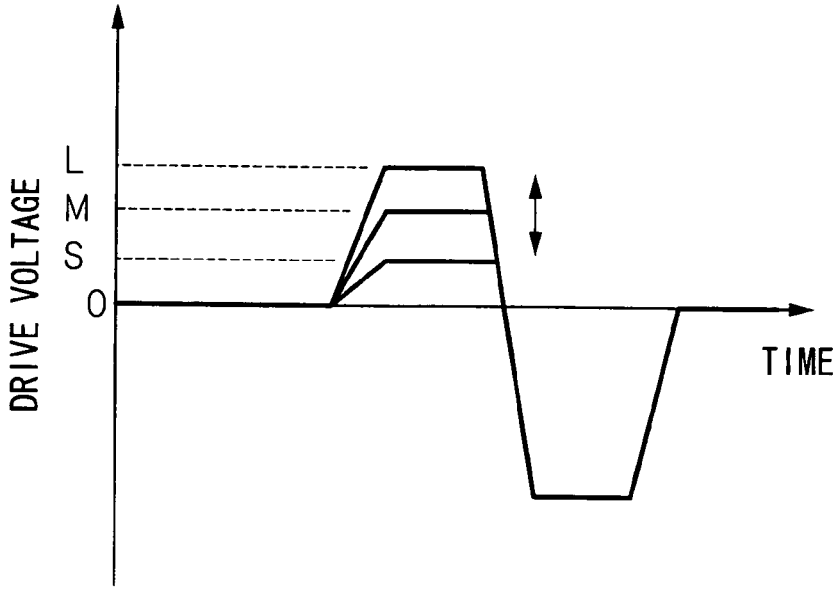
FIG. 13 is an illustrative diagram showing an example of controlling the liquid droplet ejection volume in the central nozzles according to the first embodiment.

FIG. 13 shows an embodiment of the control of the liquid droplet ejection volume of the central nozzles 151, and it shows drive voltage waveforms applied to the actuators 58 provided correspondingly to the pressure chambers 52 connected to the central nozzles 151. For example, in order to change the liquid droplet ejection volume of the central nozzles 151 in three stages (large/medium/small) as shown in FIG. 12, the magnitude of the drive voltage applied to the actuators 58 is changed as shown in FIG. 13.

Next, the print determination unit 24 measures the density distribution of the lines of the test patterns, as shown in FIG. 9 (step S120). In the example in FIG. 12, the density distribution of each of the straight lines is measured for each of the test patterns. The density distribution may be measured over the whole region of each line, or it may be measured by focusing on the sections corresponding to the juncture regions, where density non-uniformity is more readily visible.

Next, an adjusted liquid droplet ejection volume A is selected, being the liquid droplet ejection volume of the central nozzles 151 when forming the line determined to have the smallest variation in density, of the lines in each of the test patterns (step S130).

Figure 14:
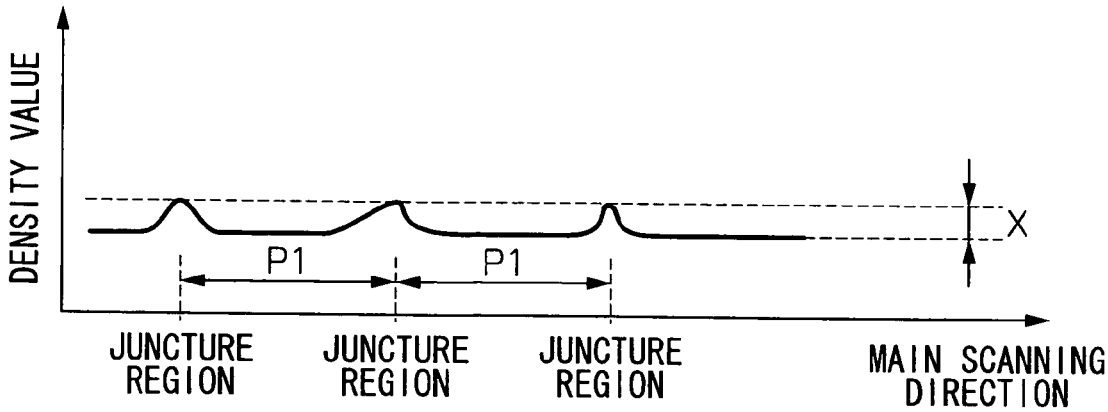
FIG. 14 is an illustrative diagram showing an example of measurement result for density distribution.

FIG. 14 shows an example of the measurement results of density distribution by the print determination unit 24, in which the horizontal axis represents the main scanning direction, and the vertical axis represents the density value. Density measurement results such as those shown in FIG. 14 are obtained for the lines in each of the test patterns, at step S120. For example, in the case shown in FIG. 12, measurement results for three density distributions are obtained for each of the test patterns 100A, 100B and 100C. In FIG. 14, regions having a different density value appear in the juncture regions (in other words, at the nozzle pitch P1 between the nozzles that are mutually adjacent in the main scanning direction). The differential between the density value in the juncture regions and the density value in the other regions (amplitude of density variation), is taken to be X. At step S130, the adjusted liquid droplet ejection volume A is selected by taking the liquid droplet ejection volume of the central nozzle 151 when forming the line having the smallest value of the density variation amplitude X, for each of the test patterns.

Figure 15:
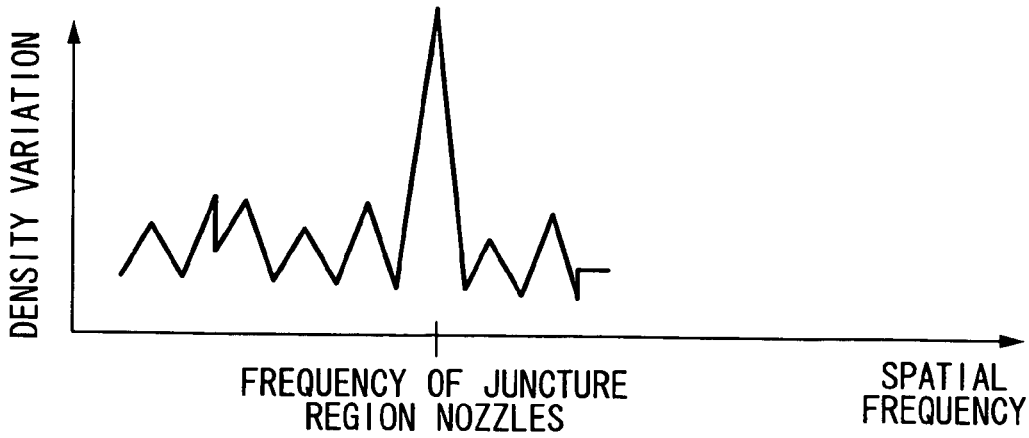
FIG. 15 is an illustrative diagram showing the results of a spatial frequency analysis of the measurement results for density distribution shown in FIG. 14.

FIG. 15 shows a frequency analysis of the measurement results of the density distribution shown in FIG. 14, where the horizontal axis represents the spatial frequency and the vertical axis represents the density variation. As shown in FIG. 15, the system controller 72 (see FIG. 7) performs a spatial frequency analysis of the measurement results for density distribution, and it selects, as the adjusted liquid droplet ejection volume A, the liquid droplet ejection volume of the central nozzles 151 used when forming the line which produced the lowest density variation in the frequency at which the central nozzles 151 appear (the frequency of the juncture region nozzles).

The adjusted liquid droplet ejection volume A of the central nozzles 151 is thus selected with respect to each of the test patterns corresponding to the output densities d. The values of the adjusted liquid droplet ejection volume A are then stored in the memory unit (not shown), in the form of a data table. In the example shown in FIG. 12, the adjusted liquid droplet ejection volumes A1, A2 and A3 for the central nozzles 151 are respectively selected for the output densities d1, d2 and d3 in the test patterns. Then, the adjusted liquid droplet ejection volumes A1, A2 and A3 for the central nozzles 151 thus selected are associated respectively with the output densities d1, d2 and d3, and are set in the data table, as shown by the data table example in FIG. 16A. Alternatively, as shown in FIG. 16B, it is also possible to associate the adjusted liquid droplet ejection volumes of the central nozzles 151 with the output densities of prescribed ranges.

Thereupon, the angle of the print head 50 with respect to the paper feed direction (head angle) a is measured (step S140). The head angle $\alpha$ is measured by the head angle determination unit 90, as stated previously. As shown in FIG. 17, the head angle $\alpha$ thus measured is stored in the memory unit (not shown), as a current value indicating the current head angle.

Thereupon, if the processing for all of the print heads 50 is not completed, then the procedure returns to step S110, and similar processing is repeated for the unprocessed print heads 50. If the processing has been completed for all of the print heads 50, then the current procedure terminates (step S150). In this way, initial settings are made for the print heads 50 (12K, 12C, 12M and 12Y) provided for the respective colors.

FIG. 10 shows a procedure during a print operation of the print head 50. Here, it is supposed that the initial setting procedure shown in FIG. 9 has already been implemented.

Firstly, the output density d' is determined on the basis of the image data, as shown in FIG. 10 (step S210).

Next, the adjusted liquid droplet ejection volume A for the central nozzles 151 is selected, in accordance with the output density d' determined from the image data, from the data table stored in the memory unit (not shown) in step 130 in FIG. 9 (step S220). If there is no adjusted liquid droplet ejection volume A corresponding precisely to the output density d' in the data table, then the corrected liquid droplet ejection A corresponding to the output density d that is closest to the output density d' is selected.

Control is then implemented through the head driver 84 in such a manner that the central nozzles 151 eject droplets at the adjusted liquid droplet ejection volume A (step S230). In this case, the nozzles 51 of the print head 50 other than the central nozzles 151 perform a normal droplet ejection operation. When the droplet ejection operation corresponding to the image data has completed, the present procedure terminates.

FIG. 11 shows a procedure in a case where the print head 50 is temporarily removed from and then reinstalled on the print unit 12. Here, it is supposed that the initial setting procedure shown in FIG. 9 has already been implemented.

As shown in FIG. 11, firstly, the current head angle $\alpha'$ is measured by the head angle determination unit 90 (step S310).

Next, the current head angle $\alpha'$ is compared with the head angle $\alpha$ stored in the memory unit (not shown) (step S320).

If there is a difference between the head angle $\alpha'$ and the head angle $\alpha$ (i.e., $\alpha' \neq \alpha$), then it is judged whether or not the head angle $\alpha'$ is within a beforehand settled prescribed range (step S330).

If the head angle $\alpha'$ lies outside this prescribed range, then the print head 50 is removed again and then reinstalled (step S340). Returning to step S310, the head angle $\alpha'$ is measured again and similar processing to that described above is carried out.

Figures 18, 19:
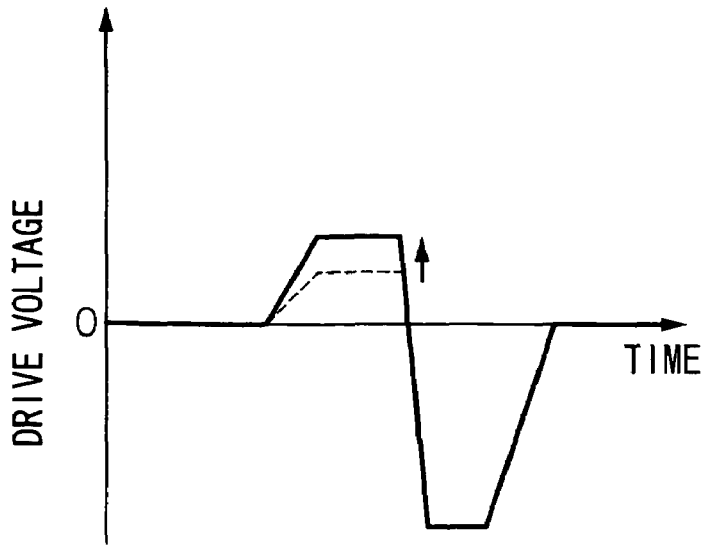
FIG. 18 is an illustrative diagram showing an example of an ejection volume correction table according to the first embodiment.
FIG. 19 is an illustrative diagram showing an example of drive waveform control according to the first embodiment.

If, on the other hand, the head angle $\alpha'$ lies within the prescribed range at step S330, then the liquid droplet ejection volume of the central nozzles 151 is corrected in accordance with the angle differential between the head angle $\alpha'$ and the head angle $\alpha$ (i.e., $\alpha'-\alpha$). For example, the ejection volume correction table shown in FIG. 18 is beforehand stored in the memory unit (not shown), and the voltage value correction coefficient corresponding to the angle differential is determined from the ejection volume correction table. The liquid droplet ejection volume of the central nozzles 151 is corrected by multiplying the drive voltage of the actuators 58 having the waveform shown in FIG. 19, by the voltage value correction coefficient (step S350). In FIG. 19, the broken line shows the drive voltage waveform before correction and the solid line shows the drive voltage waveform after correction. The current head angle $\alpha'$ and the corrected liquid droplet ejection volume for the central nozzles 151 (or the voltage value correction coefficient), are stored in the memory unit (not shown) as current values (step S360).

If, at step S320, the current head angle α' is equal to the head angle α (i.e., α'=α), or if the processing in step 360 has been completed, then the current procedure terminates.

In this way, in the print head 50 according to the present embodiment, the initial settings are made in accordance with the flowchart shown in FIG. 9, and the adjusted liquid droplet ejection volumes A for the central nozzles 151 corresponding to the output densities d are stored in the memory unit (not shown), in the form of the data table. The angle (head angle) α of the print head 50 with respect to the paper feed direction is also stored in the memory unit as a value which represents the current head angle.

During a printing operation of the print head 50, the adjusted liquid droplet ejection volume A for the central nozzles 151 corresponding to the output density d', as determined on the basis of the image data, is selected from the data table stored in the memory unit (not shown), in accordance with the flowchart shown in FIG. 10, and control is implemented in such a manner that the central nozzles 151 eject droplets at the adjusted liquid droplet ejection volume A.

Furthermore, if the print head 50 is removed and then reinstalled as during head maintenance, for example, then the current head angle α' is measured in accordance with the flowchart shown in FIG. 11, compared with the head angle α stored in the memory unit (not shown), and the liquid droplet ejection volume of the central nozzles 151 is corrected accordingly.

As described above, in the print head 50 according to the present embodiment, by disposing the central nozzle 151 in an approximately central position between the juncture region nozzles, the nozzle pitch in the sub-scanning direction in the juncture region becomes approximately one half, and therefore, the visibility of density non-uniformity occurring in the juncture regions can be reduced.

Furthermore, in the print head 50 according to the present embodiment, it is possible further to reduce the visibility of the density non-uniformity in the main scanning direction, by implementing control which adjusts the liquid droplet ejection volume for the central nozzles 151. In particular, the liquid droplet ejection volume of the central nozzles 151 is corrected in accordance with the head angle and the output density, and therefore it is possible to reduce the visibility of the density non-uniformity occurring in the juncture regions, more precisely and more accurately.

Second Embodiment

Next, a second embodiment of the present invention is described. Below, the parts of the second embodiment which are common to the first embodiment described above are not described below, and the explanation focuses on the characteristic features of the present embodiment. Furthermore, in the drawings described below, items which are common to those of the first embodiment are denoted with the same reference numerals.

Figure 20:
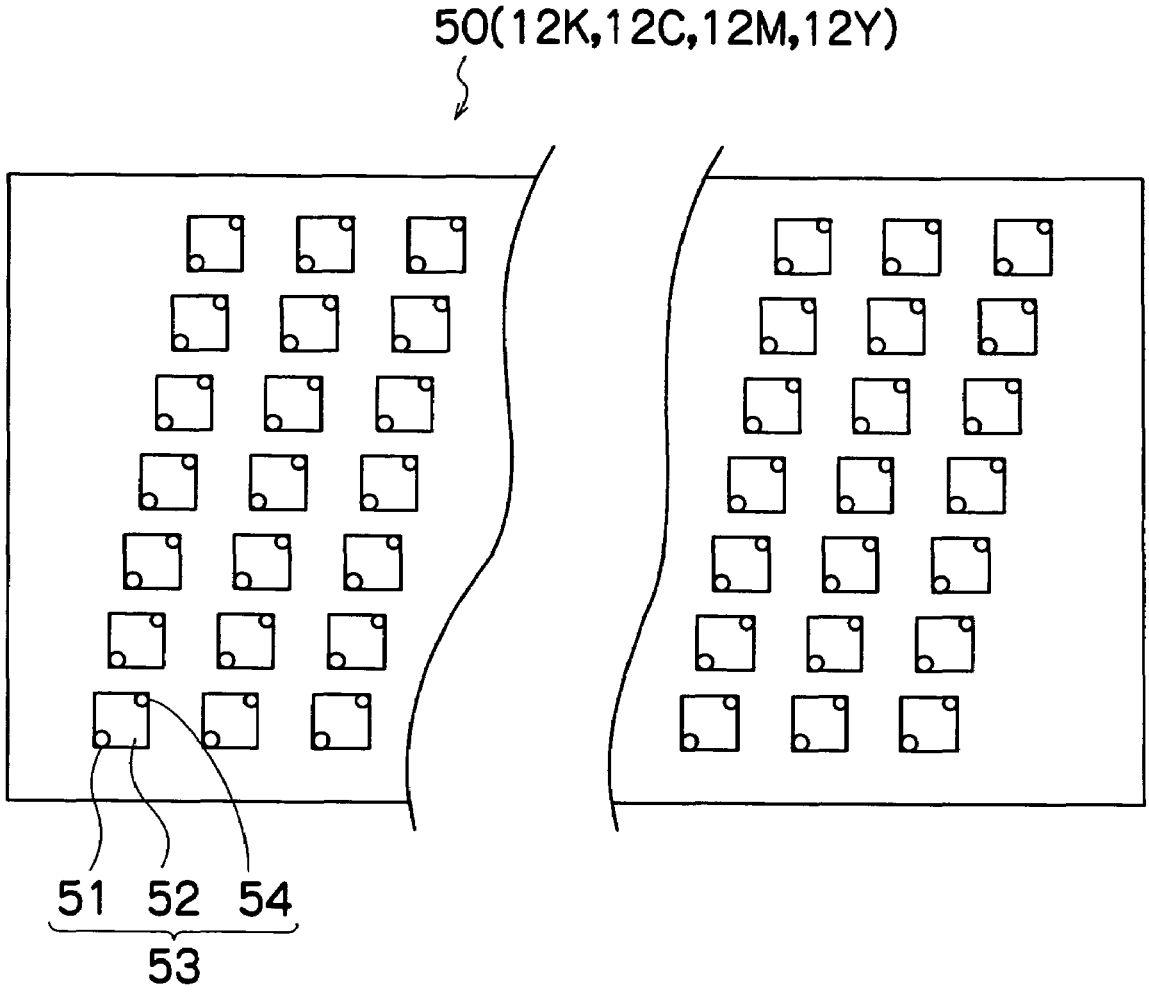
FIG. 20 is a plan view perspective diagram showing the structure of the print head according to the second embodiment.
Figure 21:
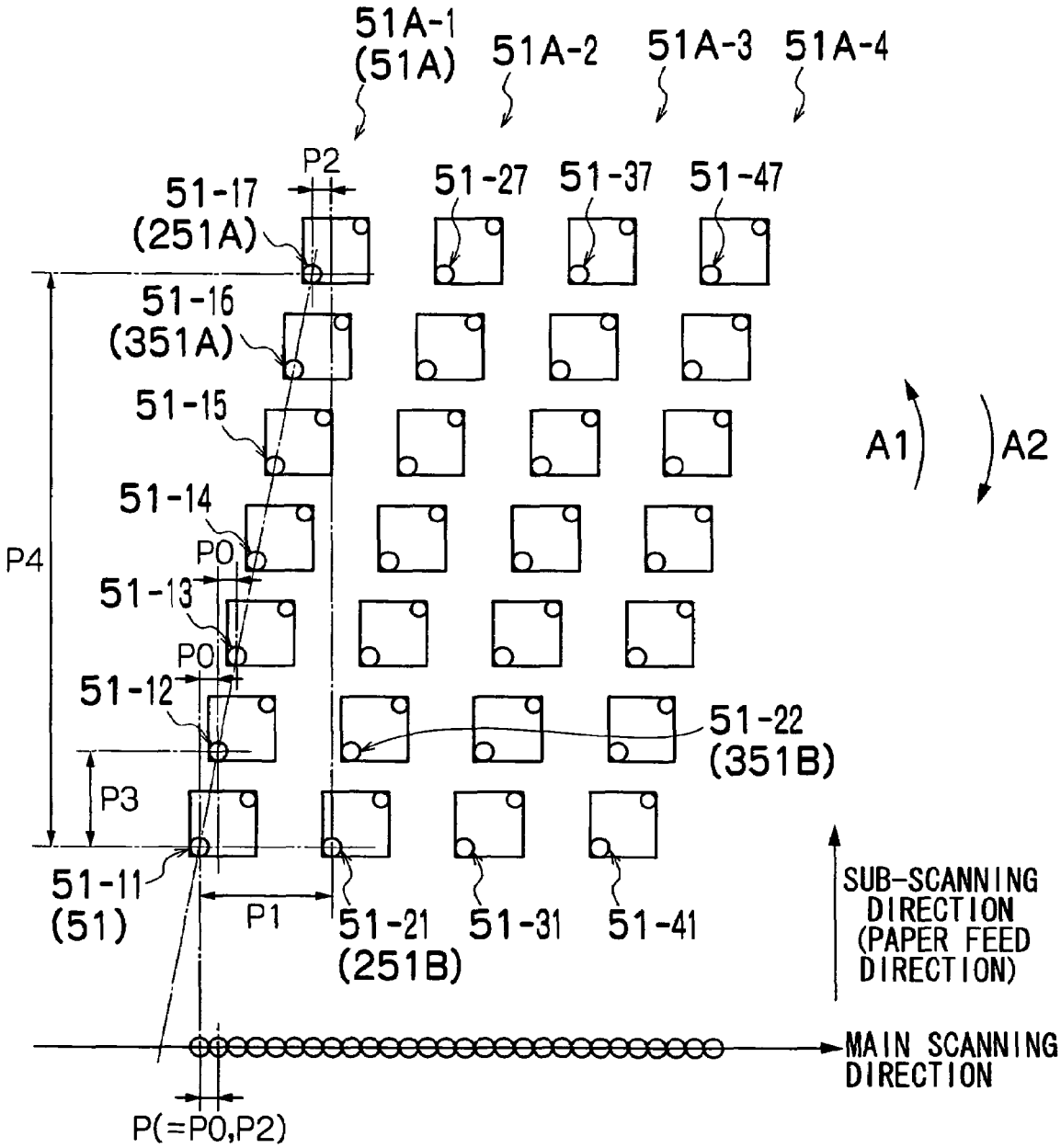
FIG. 21 is an enlarged view showing an example of the nozzle arrangement in the print head shown in FIG. 20.

FIG. 20 is a plan view perspective diagram showing an embodiment of the structure of the print head 50 according to the second embodiment of the present invention, and FIG. 21 is an enlarged diagram showing the nozzle arrangement in the print head 50 shown in FIG. 20. As shown in FIGS. 20 and 21, the nozzle arrangement of the print head 50 according to the present embodiment is similar to the nozzle arrangement of the matrix type head in the related art shown in FIG. 30; namely, it has a structure in which the plurality of nozzles 51 (ink chamber units 53) are arranged in a fixed arrangement pattern following a row direction aligned with the main scanning direction and an oblique column direction which is not perpendicular to the main scanning direction.

Furthermore, the juncture region (nozzle row junction section) is the boundary (unction section) between nozzle rows 51A that are mutually adjacent in the main scanning direction, and is, for example, the region between the nozzle 51-17 at the end section of the nozzle row 51A-1 on the upstream side in the main scanning direction, and the nozzle 51-21 at the end section of nozzle row 51A-2 on the downstream side in the main scanning direction. Furthermore, in this case, the juncture region nozzles, which are the nozzles at the ends of nozzle rows in the oblique column direction, situated in the juncture region, are the nozzles 51-17 and 51-21. Below, the juncture region nozzles are all indicated by the reference numeral 251, and in particular, of the two nozzle rows 51A that are mutually adjacent in the main scanning direction, the juncture region nozzle at the downstream side end (in terms of the main scanning direction) of the nozzle row 51A on the upstream side in the main scanning direction is denoted with the reference numeral 251A, and the juncture region nozzle at the upstream side end (in terms of the main scanning direction) of the nozzle row 51A on the downstream side in the main scanning direction is denoted with the reference numeral 251B. In the case described above, the juncture region nozzle 251A is the nozzle 51-17, and the juncture region nozzle 251B is the nozzle 51-21.

If the print head 50 has been installed accurately in such a manner that it forms the prescribed angle with respect to the sub-scanning direction (paper feed direction), then the nozzle pitch in the main scanning direction between the juncture region nozzles 251A and 251B (namely, the nozzle pitch in the main scanning direction in the juncture region) P2, is equal to the nozzle pitch P0 in the main scanning direction in the other regions (i.e., P2=P0), and hence the nozzles are aligned at regular intervals at the nozzle pitch of P0 (=P2) when projected to the main scanning direction. Consequently, as shown in the lower part of FIG. 21, a row of dots aligned at regular intervals at the dot pitch P (=P0, P2), is formed in the main scanning direction of the recording paper 16.

In the second embodiment, in order to reduce the visibility of the density non-uniformity occurring due to the juncture regions, droplet ejection is controlled so as to adjust the liquid droplet ejection volume of the juncture region nozzles 251A and 251B, instead of the central nozzles 151 in the first embodiment. This droplet ejection control is performed principally in the liquid droplet volume adjustment unit 80A included in the print controller 80 in FIG. 7. More specifically, the print determination unit 24 measures the density distribution of the test patterns, and on the basis of the measurement results, the liquid droplet volume adjustment unit 80A implements control for adjusting the liquid droplet ejection volume of the juncture region nozzles 251A and 251B of the print head 50, through the head driver 84.

Next, a method for controlling droplet ejection in the print head 50 according to the second embodiment is described in detail.

In the present embodiment, if the print head 50 is installed with a tilt in the direction of arrow A1 in FIG. 21, then adjustment is performed so as to increase the liquid droplet ejection volume of the juncture region nozzles 251 (251A and 251B), whereas conversely, if the print head 50 is installed with a tilt in the direction of arrow A2 in FIG. 21, then adjustment is performed so as to reduce the liquid droplet ejection volume of the juncture region nozzles 251 (251A and 251B). Below, the present droplet ejection control method is described in detail with reference to the flowcharts in FIGS.

22 to 24, which show the droplet ejection control method of the print head 50 according to the present embodiment.

Figure 22:
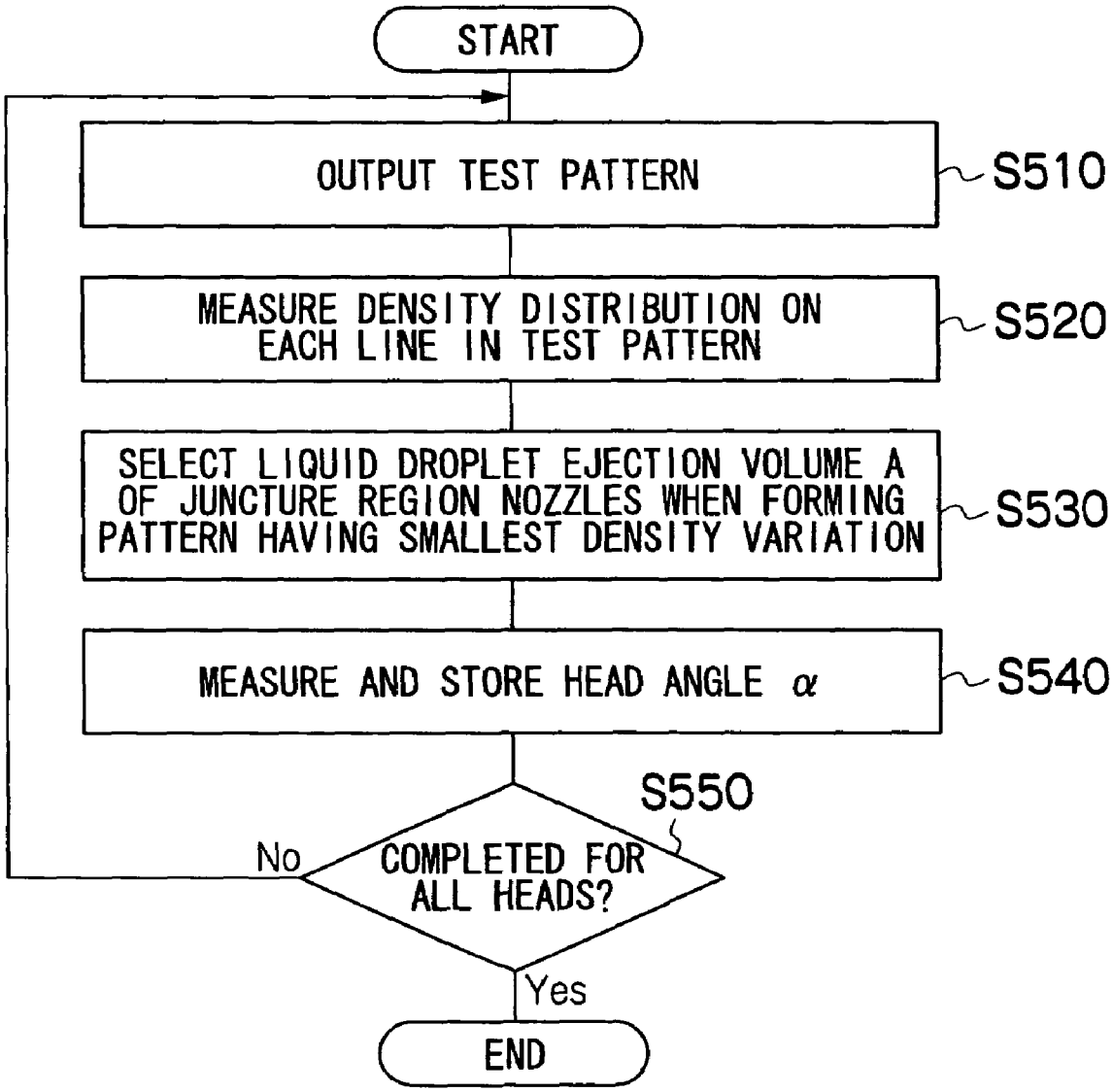
FIG. 22 is a flowchart showing an initial setting procedure for the print head according to the second embodiment.

FIG. 22 shows an initial setting procedure for the print head 50.

As shown in FIG. 22, firstly, test patterns are outputted to a sheet of recording medium 16, at respective output densities (step S510). In this case, a plurality of patterns are outputted while changing the liquid droplet ejection volumes (adjusting values) of the juncture region nozzles 251 (251A and 251B).

Figure 25:
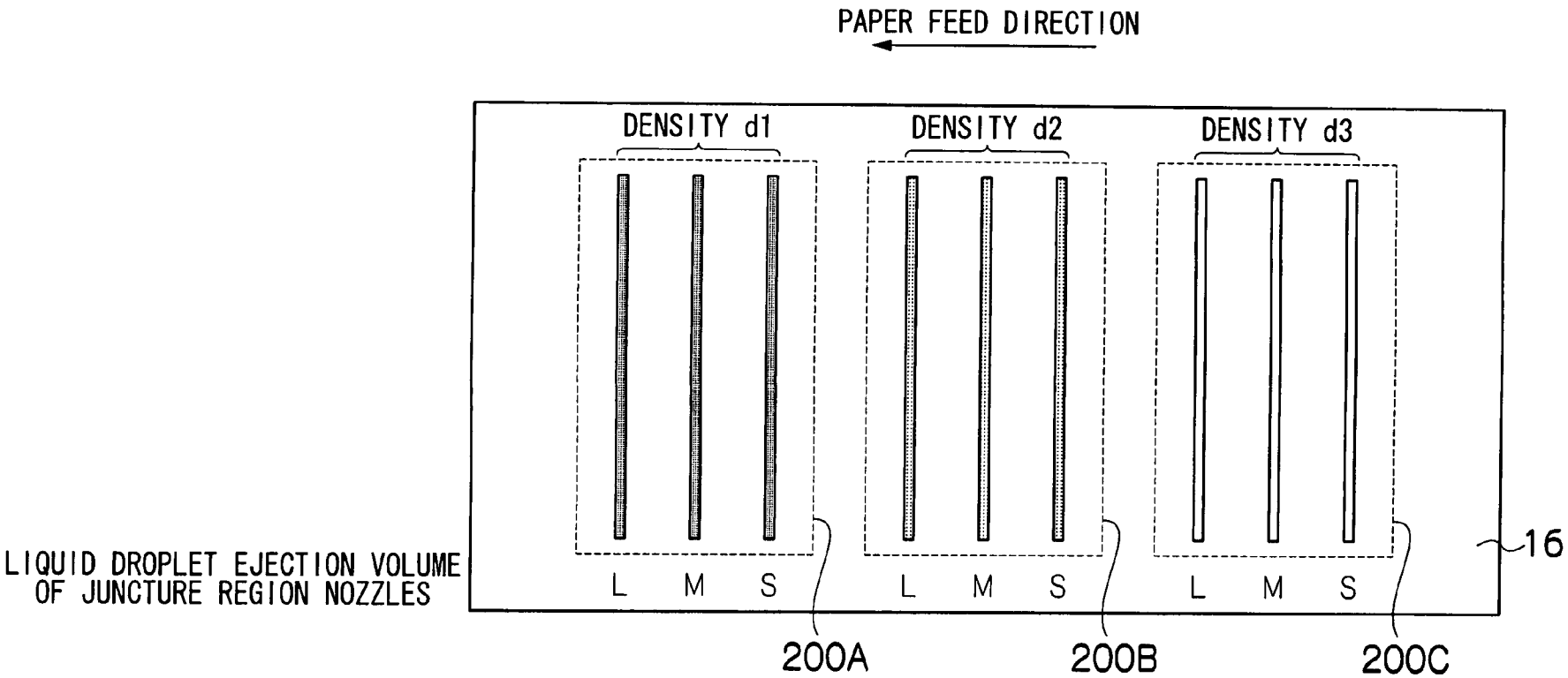
FIG. 25 is an illustrative diagram showing an example of a test pattern.

FIG. 25 shows an embodiment of the test patterns. As shown in FIG. 25, test patterns 200A, 200B and 200C are outputted respectively for output densities d1, d2 and d3. Each of the test patterns 200A, 200B and 200C is constituted by a plurality of straight lines in the main scanning direction perpendicular to the paper feed direction, which are outputted by changing the liquid droplet ejection volume of the juncture region nozzles 251 (251A, 251B) in three stages (large/medium/small). The test patterns constituted by the straight lines extending in the main scanning direction are favorable for measuring variations in density in the main scanning direction. Furthermore, by forming the test patterns for the respective output densities, it is possible to adjust the liquid droplet ejection volume of the juncture region nozzles 251 for each output density, as described later.

The control of the liquid droplet ejection volume of the juncture region nozzles 251 (251A, 251B) is carried out similarly to the process for the central nozzles 151 in the first embodiment. More specifically, for example, in order to change the liquid droplet ejection volume of the juncture region nozzles 251 in three stages (large/medium/small) as shown in FIG. 25, the magnitude of the drive voltage applied to the actuators 58 is changed as shown in FIG. 13.

Next, the print determination unit 24 measures the density distribution of the lines of the test patterns, as shown in FIG. 22 (step S520). In the example in FIG. 25, the density distribution of each of the straight lines is measured for each of the test patterns. The density distribution may be measured over the whole region of each line, or it may be measured by focusing on the sections corresponding to the juncture regions, where density non-uniformity is more readily visible.

Next, an adjusted liquid droplet ejection volume A is selected, being the liquid droplet ejection volume of the juncture region nozzles 251 (251A, 251B) when forming the line determined to have the smallest variation in density, of the lines in each of the test patterns (step S530).

The measurement results of the density distribution measured by the print determination unit 24, and the spatial frequency analysis of these results, are similar to those shown in FIGS. 14 and 15 and described previously. The method of selecting the adjusted liquid droplet ejection volume A on the basis of these results is similar to that of the first embodiment.

The adjusted liquid droplet ejection volume A of the juncture region nozzles 251 (251A, 251B) is thus selected with respect to each of the test patterns corresponding to the output densities d. The values of the adjusted liquid droplet ejection volume A are then stored in the memory unit (not shown), in the form of a data table. In the example shown in FIG. 25, the adjusted liquid droplet ejection volumes A1, A2 and A3 for the juncture region nozzles 251 are respectively selected for the output densities d1, d2 and d3 in the test patterns. Then, the adjusted liquid droplet ejection volumes A1, A2 and A3 for the juncture region nozzles 251 thus selected are associated respectively with the output densities d1, d2 and d3, and are set in the data table, as shown by the data table example in FIG. 26A. Alternatively, as shown in FIG. 26B, it is also possible to associate the adjusted liquid droplet ejection volumes of the juncture region nozzles 251 with the output densities of prescribed ranges.

Thereupon, the angle of the print head 50 with respect to the paper feed direction (head angle) a is measured (step S540). The head angle $\alpha$ is measured by the head angle determination unit 90 shown in FIG. 7, similarly to the first embodiment. As shown in FIG. 17, the head angle $\alpha$ thus measured is stored in the memory unit (not shown), as a current value indicating the current head angle.

Thereupon, if the processing for all of the print heads 50 is not completed, then the procedure returns to step S510, and similar processing is repeated for the unprocessed print heads 50. If the processing has been completed for all of the print heads 50, then the current procedure terminates (step S550). In this way, initial settings are made for the print heads 50 (12K, 12C, 12M and 12Y) provided for the respective colors.

Figure 23:
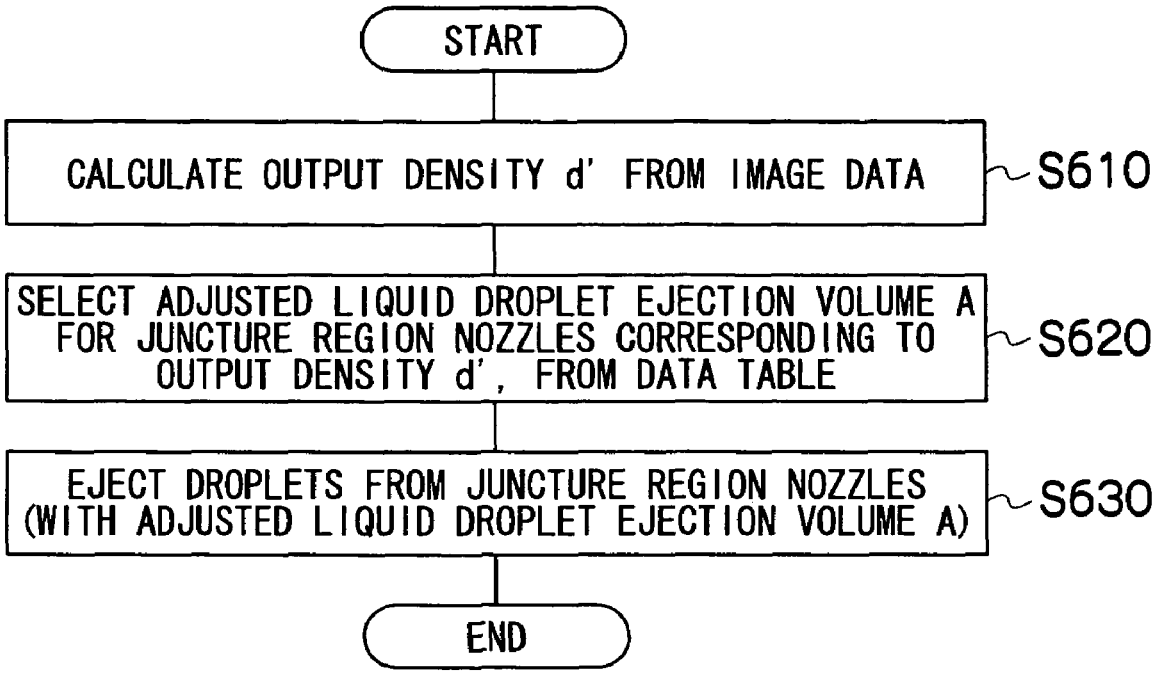
FIG. 23 is a flowchart showing a droplet ejection control procedure for the print head during a printing operation according to the second embodiment.

FIG. 23 shows a procedure during a print operation of the print head 50. Here, it is supposed that the initial setting procedure shown in FIG. 22 has already been implemented.

Firstly, the output density d' is determined on the basis of the image data, as shown in FIG. 23 (step S610).

Next, the adjusted liquid droplet ejection volume A for the juncture region nozzles 251 is selected, in accordance with the output density d' determined from the image data, from the data table stored in the image unit (not shown) in step 530 in FIG. 22 (step S620). If there is no adjusted liquid droplet ejection volume A corresponding precisely to the output density d' in the data table, then the corrected liquid droplet ejection A corresponding to the output density d that is closest to the output density d' is selected.

Control is then implemented through the head driver 84 in such a manner thin the juncture region nozzles 251 eject droplets at the adjusted liquid droplet ejection volume A (step S630). In this case, the nozzles 51 of the print head 50 other than the juncture region nozzles 251 perform a normal droplet ejection operation. When the droplet ejection operation corresponding to the image data has completed, the present procedure terminates.

Figure 24:
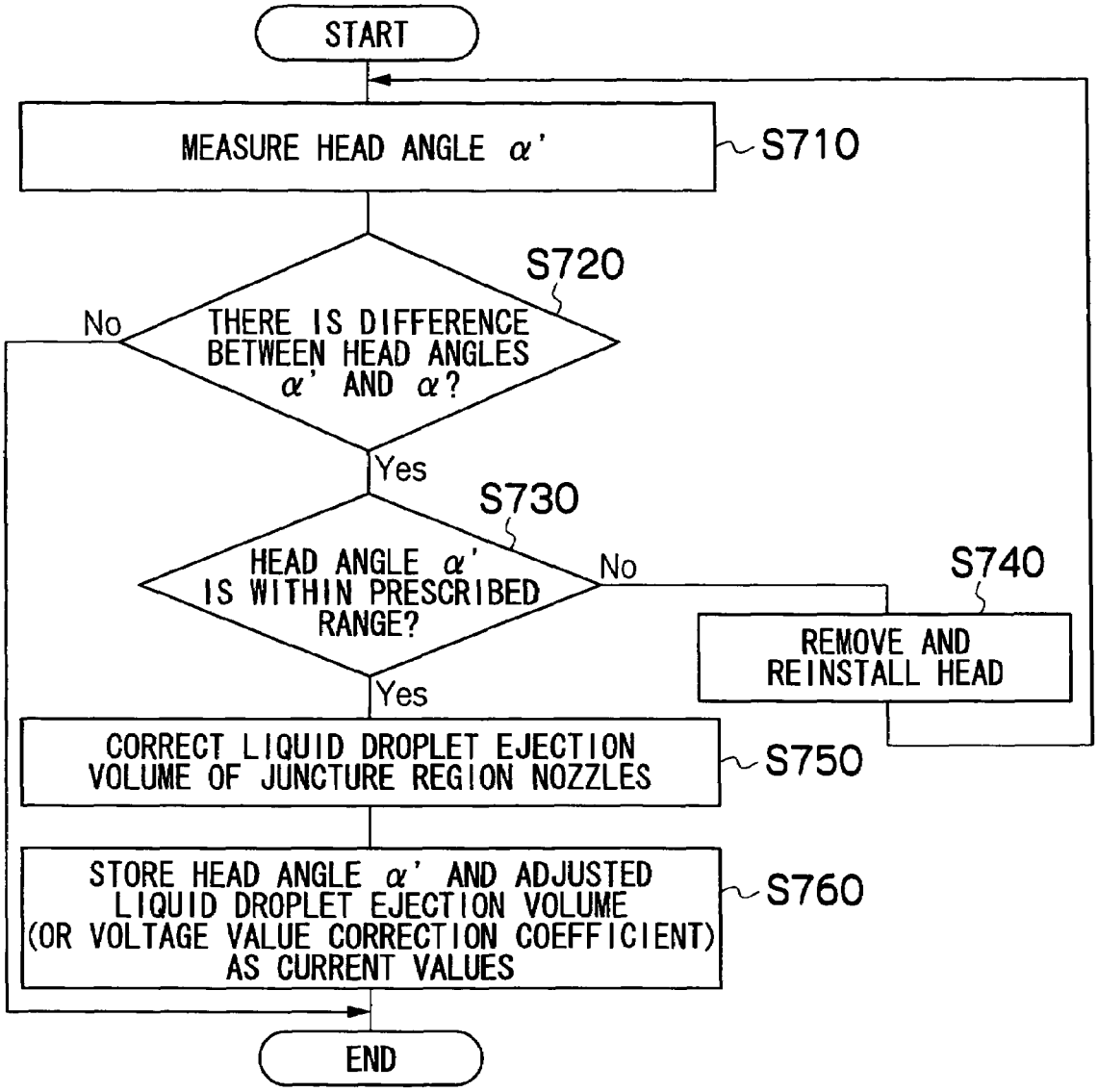
FIG. 24 is a flowchart showing a procedure of reinstalling the print head according to the second embodiment.

FIG. 24 shows a procedure in a case where the print head 50 is temporarily removed from and then reinstalled on the print unit 12. Here, it is supposed that the initial setting procedure shown in FIG. 22 has already been implemented.

As shown in FIG. 24, firstly, the current head angle $\alpha'$ is measured by the head angle determination unit 90 (step S710).

Next, the current head angle $\alpha'$ is compared with the head angle $\alpha$ stored in the memory unit (not shown) (step 720).

If there is a difference between the head angle $\alpha'$ and the head angle $\alpha$ (i.e., $\alpha' \neq \alpha$), then it is judged whether or not the head angle $\alpha'$ is within a beforehand settled prescribed range (step S730).

If the head angle $\alpha'$ lies outside this prescribed range, then the print head 50 is removed again and then reinstalled (step S740). Returning to step S710, the head angle $\alpha'$ is measured again and similar processing to that described above is carried out.

If, on the other hand, the head angle $\alpha'$ lies within the prescribed range at step S730, then the liquid droplet ejection volume of the juncture region nozzles 251 is corrected in accordance with the angle differential between the head angle $\alpha'$ and the head angle $\alpha$ (i.e., $\alpha'-\alpha$). For example, an ejection volume correction table shown in FIG. 27 is beforehand stored in the memory unit (not shown), and the voltage value correction coefficient corresponding to the angle differential is determined from the ejection volume correction table. The liquid droplet ejection volume of the juncture region nozzles 251 is corrected by multiplying the drive voltage of the actuators 58 having the waveform shown in FIG. 19, by the voltage value correction coefficient (step S750). The current head angle α' and the corrected liquid droplet ejection volume for the juncture region nozzles 251 (or the voltage value correction coefficient), are stored in the memory unit (not shown) as current values (step S760).

If, at step S720, the current head angle α' is equal to the head angle α (i.e., α'=α), or if the processing in step 760 has been completed, then the current procedure terminates.

In this way, in the print head 50 according to the present embodiment, the initial settings are made in accordance with the flowchart shown in FIG. 22, and the adjusted liquid droplet ejection volumes A for the juncture region nozzles 251 corresponding to the output densities d are stored in the memory unit (not shown), in the form of the data table. The angle (head angle) a of the print head 50 with respect to the paper feed direction is also stored in the memory unit as a value which represents the current head angle.

During a printing operation of the print head 50, the adjusted liquid droplet ejection volume A for the juncture region nozzles 251 corresponding to the output density d', as determined on the basis of the image data, is selected from the data table stored in the memory unit (not shown), in accordance with the flowchart shown in FIG. 23, and control is implemented in such a manner thin the juncture region nozzles 251 eject droplets at the adjusted liquid droplet ejection volume A.

Furthermore, if the print head 50 is removed and then reinstalled as during head maintenance, for example, then the current head angle α' is measured in accordance with the flowchart shown in FIG. 24, compared with the head angle a stored in the memory unit (not shown), and the liquid droplet ejection volume of the juncture region nozzles 251 is corrected accordingly.

As described above, in the print head 50 according to the present embodiment, it is possible further to reduce the visibility of the density non-uniformity occurring in the juncture regions, by implementing control which adjusts the liquid droplet ejection volume for the juncture region nozzles 251. In particular, the liquid droplet ejection volume of the juncture region nozzles 251 is corrected in accordance with the head angle and the output density, and therefore it is possible to reduce the visibility of the density non-uniformity occurring in the juncture regions, more precisely and more accurately.

Next, a modification embodiment of the second embodiment of the present invention is described. In the present embodiment, the liquid droplet ejection volume is controlled not only in respect of the juncture region nozzles 251, but also the nozzles adjacent to the juncture region nozzles 251 in the main scanning direction. In FIG. 21, the nozzles adjacent to the juncture region nozzles corresponding to the juncture region nozzles 51-17 (251A) and 51-21 (251B) are the nozzles 51-16 and 51-22, respectively. The juncture region adjacent nozzles corresponding to the juncture region nozzles 251 are denoted with the reference numeral 351, and the juncture region adjacent nozzles corresponding to the juncture region nozzles 251A and 251B are respectively denoted with the reference numerals 351A and 351B.

When the control corresponding to the juncture region nozzles 251 (251A, 251B) has been carried out as described above, the visibility of the density non-uniformity occurring in the juncture regions is reduced due to the adjustment of the liquid droplet ejection volume of the juncture region nozzles 251 (251A, 251B). However, this adjustment may be a factor causing a new density non-uniformity to become visible between the juncture region nozzles 251 and the corresponding juncture region adjacent nozzles 351 (namely, between the juncture region nozzle 251A and the juncture region adjacent nozzle 351A, and between the juncture region nozzle 251B and the juncture region adjacent nozzle 351B). Therefore, in the present embodiment, in order to reduce the visibility of the new density non-uniformity occurring due to adjustment of the liquid droplet ejection volume of the juncture region nozzles 251, control is implemented in order to correct the liquid droplet ejection volume of the juncture region adjacent nozzles 351 (351A, 351B).

FIG. 28 is an ejection volume correction table according to the present embodiment, and this table is used in place of the ejection volume correction table shown in FIG. 27. In the ejection volume correction table shown in FIG. 28, a voltage value correction coefficient is set for the juncture region adjacent nozzles 351 (351A, 351B), as well as setting a voltage value correction coefficient for the juncture region nozzles 251 (251A, 251B), in accordance with the angle differential (α'−α) between the current head angle α' and the head angle a stored in the memory unit (not shown). In this ejection volume correction table, if the voltage value correction coefficient of the juncture region nozzles 251 is greater than 1 for a certain angle differential, then the voltage value correction coefficient of the juncture region adjacent nozzles 351 is set to be smaller than 1 for this angle differential. In other words, if the liquid droplet ejection volume of the juncture region nozzles 251 is increased in the correction process, then at the same time, the liquid droplet ejection volume of the juncture region adjacent nozzles 351 is corrected so as to be reduced.

Figure 29B:
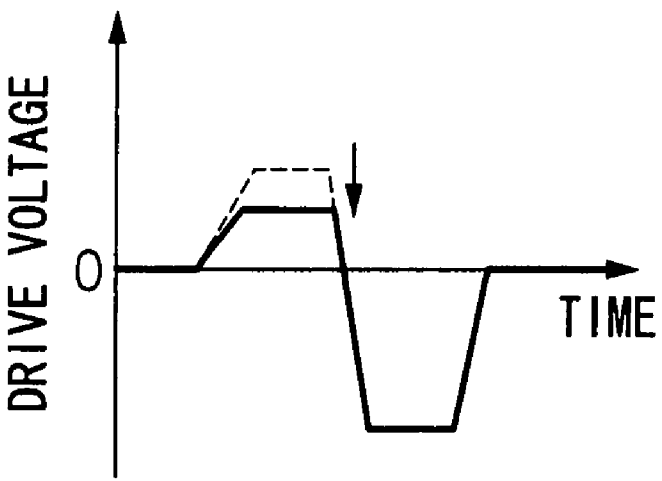
FIGS. 29A and 29B are illustrative diagrams showing a state of the drive waveform control according to the modification of the second embodiment.
Figure 29A:
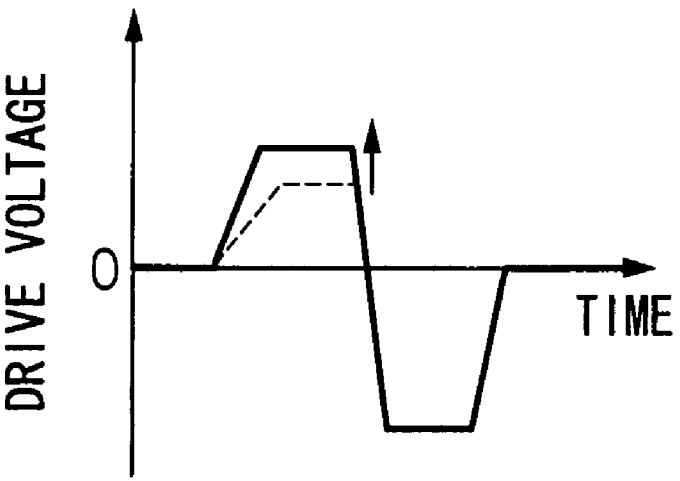

FIGS. 29A and 29B show drive voltage waveforms applied to the actuators 58 corresponding to the juncture region nozzle 251 and the juncture region adjacent nozzle 351, respectively, and the broken lines represent the drive voltage waveforms before correction, whereas the solid lines represent the drive voltage waveforms after correction. When the drive waveform of the juncture region nozzles 251 is corrected so as to become larger as shown in FIG. 29A, the drive voltage of the juncture region adjacent nozzles 351 is corrected so as to become smaller as shown in FIG. 29B.

Furthermore, if the voltage value correction coefficients of the juncture region nozzles 251 and the juncture region adjacent nozzles 351 are inverted, then conversely to the foregoing description, the liquid droplet ejection volume of the juncture region nozzles 251 is corrected so as to become smaller, and the liquid droplet ejection volume of the juncture region adjacent nozzles 351 is corrected so as to become larger.

Moreover, the voltage value correction coefficients are set in such a manner that the absolute value of the differential achieved by subtracting 1 from the voltage value correction coefficient is smaller in the case of the juncture region adjacent nozzles 351 than in the case of the juncture region nozzles 251. The absolute value of the differential achieved by subtracting 1 from the correction coefficient defines the absolute correction rate. In other words, the absolute correction rate for the juncture region adjacent nozzles 351 is set so as to be smaller than the absolute correction rate for the juncture region nozzles 251. For example, in the table shown in FIG. 28, when the angle differential (α'−α) is −0.005 degrees, the absolute correction rate for the juncture region adjacent nozzles is |0.952−1|=0.048, and is smaller than the absolute correction rate for the juncture region nozzles being |1.117−1|=0.117. When the angle differential (α'−α) is 0.001 degrees, the absolute correction rate for the juncture region adjacent nozzles is |1.011−1|=0.011, and is smaller than the absolute correction rate for the juncture region nozzles being |0.979−1|=0.021.

In this way, in the present embodiment, the liquid droplet ejection volume of the juncture region adjacent nozzles 351 is corrected, as well as that of the juncture region nozzles 251. Accordingly, in addition to reducing the density non-uniformity occurring in the juncture regions, it is also possible to reduce the visibility of density non-uniformity that is caused by the correction of the liquid droplet ejection volume of the juncture region nozzles 251.

In particular, correction is performed in such a manner that the liquid droplet ejection volume of the juncture region adjacent nozzles 351 is increased when the liquid droplet ejection volume of the juncture region nozzles 251 is reduced in the correction process, whereas the liquid droplet ejection volume of the juncture region adjacent nozzles 351 is reduced when the liquid droplet ejection volume of the juncture region nozzles 251 is increased in the correction process. In other words, the liquid droplet ejection volumes of the juncture region nozzles 251 and the juncture region adjacent nozzles 351 are corrected in opposite phases. Moreover, the absolute correction rate for the liquid droplet ejection volume of the juncture region adjacent nozzles 351 is set to be smaller than the absolute correction rate for the liquid droplet ejection volume of the juncture region nozzles 251. By this means, it is possible to reduce the visibility of density non-uniformity occurring in the periphery of the juncture regions, in a smooth fashion.

The present embodiment is described with respect to a case where one nozzle adjacent to the juncture region nozzle 251 in the main scanning direction is taken to be the juncture region adjacent nozzle 351, but in implementing the present invention, it is also possible to take two or more nozzles adjacent to the juncture region nozzle 251 in the main scanning direction, as the juncture region adjacent nozzles 351. For example, in FIG. 21, it is possible to take the nozzles 51-16 and 51-15 as the juncture region adjacent nozzles corresponding to the juncture region nozzle 51-17. Desirably, a composition is adopted in which the absolute correction rate for the liquid droplet ejection volume of the juncture region adjacent nozzles 351 gradually becomes smaller as the distance from the corresponding juncture region nozzle 251 increases.

Furthermore, the foregoing embodiments are described with respect to a case where the print head 50 is a full line head, but the implementation of the present invention is not limited to this, and a shuttle type head may also be used.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid droplet ejection head having a plurality of nozzles arranged in a fixed arrangement pattern two-dimensionally in a first direction and a direction oblique to the first direction, wherein:

the nozzles compose a projected nozzle row in the first direction when supposing that the nozzles are projected so as to align in the first direction;

first one of the nozzles and second one of the nozzles are located in a juncture region;

a distance in a second direction perpendicular to the first direction between the first and second nozzles is larger than a distance in the second direction between other two of the nozzles that are located in a region other than the juncture region and sequenced in the projected nozzle row;

third at least one of the nozzles lies substantially halfway between the first and second nozzles; and the first, third and second nozzles are sequenced in the projected nozzle row.

2. The liquid droplet ejection head as defined in claim 1, wherein:

a first nozzle row of the nozzles in the oblique direction and a second nozzle row of the nozzles in the oblique direction are mutually adjacent in the first direction;

the first nozzle is at an end of the first nozzle row on a side adjacent to the second nozzle row; and the second nozzle is at an end of the second nozzle row on a side adjacent to the first nozzle row.

3. The liquid droplet ejection head as defined in claim 1, wherein:

the first direction is a main scanning direction which is substantially perpendicular to a relative conveyance direction of a recording medium with respect to the liquid droplet ejection head; and the second direction is a sub-scanning direction which coincides with the relative conveyance direction of the recording medium with respect to the liquid droplet ejection head.

4. The liquid droplet ejection head as defined in claim 1, wherein the nozzles are arranged in the projected nozzle row at regular intervals.

5. A liquid droplet ejection apparatus, comprising:

the liquid droplet ejection head as defined in claim 1; and a liquid droplet volume adjustment device which adjusts a liquid droplet ejection volume of the third nozzle.

6. The liquid droplet ejection apparatus as defined in claim 5, further comprising:

a head angle determination device which determines a head angle of the liquid droplet ejection head with respect to a prescribed direction, wherein the liquid droplet volume adjustment device adjusts the liquid droplet ejection volume of the third nozzle according to the head angle determined by the head angle determination device.

7. An image recording method using the liquid droplet ejection apparatus as defined in claim 6, wherein an image is recorded while adjusting the liquid droplet ejection volume of the third nozzle according to the head angle determined by the head angle determination device.

8. The liquid droplet ejection apparatus as defined in claim 5, further comprising:

a test pattern creating device which creates a test pattern by the liquid droplet ejection head; and a density distribution measurement device which measures a density distribution on the test pattern, wherein the liquid droplet volume adjustment device adjusts the liquid droplet ejection volume of the third nozzle according to the density distribution on the test pattern measured by the density distribution measurement device.

9. An image recording method using the liquid droplet ejection apparatus as defined in claim 8, wherein an image is recorded while adjusting the liquid droplet ejection volume of the third nozzle according to the density distribution on the test pattern measured by the density distribution measurement device.

10. The liquid droplet ejection apparatus as defined in claim 9, wherein the liquid droplet volume adjustment device corrects a liquid droplet ejection volume of a juncture region adjacent nozzle corresponding to at least one of the nozzles adjacent to the juncture region nozzle.

11. The liquid droplet ejection apparatus as defined in claim 10, wherein the liquid droplet volume adjustment device corrects the liquid droplet ejection volume of the juncture region nozzle with a correction coefficient having an absolute correction rate, and corrects the liquid droplet ejection volume of the juncture region adjacent nozzle with another correction coefficient having another absolute correction rate that is smaller than the absolute correction rate of the correction coefficient for the juncture region nozzle.

12. The liquid droplet ejection apparatus as defined in claim 11, wherein the liquid droplet volume adjustment device applies the correction coefficient having largest one of the absolute correction rates to the juncture region nozzle, and applies the correction coefficient having smaller one of the absolute correction rates to the juncture region adjacent nozzle, as a distance from the juncture region nozzle to the juncture region adjacent nozzle larger.

13. The liquid droplet ejection apparatus as defined in claim 10, wherein the liquid droplet volume adjustment device corrects the liquid droplet ejection volumes in opposite phases for the juncture region nozzle and the juncture region adjacent nozzle.

14. The liquid droplet ejection apparatus as defined in claim 5, wherein the liquid droplet volume adjustment device adjusts the liquid droplet ejection volume of the third nozzle according to an output density of an image.

15. An image recording method using the liquid droplet ejection apparatus as defined in claim 5, wherein an image is recorded while adjusting the liquid droplet ejection volume of the third nozzle.

16. A liquid droplet ejection apparatus, comprising:

a liquid droplet ejection head which has a plurality of nozzles arranged in a fixed arrangement pattern two-dimensionally in a first direction and a direction oblique to the first direction, the nozzles composing a projected nozzle row in the first direction when supposing that the nozzles are projected so as to align in the first direction, first one of the nozzles and second one of the nozzles being located in a juncture region and sequenced in the projected nozzle row, a distance in a second direction perpendicular to the first direction between the first and second nozzles being larger than a distance in the second direction between other two of the nozzles that are located in a region other than the juncture region and sequenced in the projected nozzle row; and a liquid droplet volume adjustment device which adjusts a liquid droplet ejection volume of a juncture region nozzle corresponding at least one of the first and second nozzles.

17. The liquid droplet ejection apparatus as defined in claim 16, wherein:

a first nozzle row of the nozzles in the oblique direction and a second nozzle row of the nozzles in the oblique direction are mutually adjacent in the first direction;

the first nozzle is at an end of the first nozzle row on a side adjacent to the second nozzle row; and the second nozzle is at an end of the second nozzle row on a side adjacent to the first nozzle row.

18. The liquid droplet ejection apparatus as defined in claim 16, wherein:

the first direction is a main scanning direction which is substantially perpendicular to a relative conveyance direction of a recording medium with respect to the liquid droplet ejection head; and the second direction is a sub-scanning direction which coincides with the relative conveyance direction of the recording medium with respect to the liquid droplet ejection head.

19. The liquid droplet ejection apparatus as defined in claim 16, wherein the nozzles are arranged in the projected nozzle row at regular intervals.

20. The liquid droplet ejection apparatus as defined in claim 16, further comprising:

a head angle determination device which determines a head angle of the liquid droplet ejection head with respect to a prescribed direction, wherein the liquid droplet volume adjustment device adjusts the liquid droplet ejection volume of the juncture region nozzle according to the head angle determined by the head angle determination device.

21. An image recording method using the liquid droplet ejection apparatus as defined in claim 20, wherein an image is recorded while adjusting the liquid droplet ejection volume of the juncture region nozzle according to the head angle determined by the head angle determination device.

22. The liquid droplet ejection apparatus as defined in claim 16, further comprising:

a test pattern creating device which creates a test pattern by the liquid droplet ejection head; and a density distribution measurement device which measures a density distribution on the test pattern, wherein the liquid droplet ejection volume of the juncture region nozzle is adjusted according to the density distribution on the test pattern measured by the density distribution measurement device.

23. An image recording method using the liquid droplet ejection apparatus as defined in claim 22, wherein an image is recorded while adjusting the liquid droplet ejection volume of the juncture region nozzle according to the density distribution on the test pattern measured by the density distribution measurement device.

24. The liquid droplet ejection apparatus as defined in claim 16, wherein the liquid droplet volume adjustment device adjusts the liquid droplet ejection volume of the juncture region nozzle according to an output density of an image.

25. An image recording method using the liquid droplet ejection apparatus as defined in claim 16, wherein an image is recorded while adjusting the liquid droplet ejection volume of the juncture region nozzle.

* * * * *